US011714362B2

(12) United States Patent
Kanno et al.

(10) Patent No.: US 11,714,362 B2
(45) Date of Patent: Aug. 1, 2023

(54) TONER AND TWO-COMPONENT DEVELOPER

(71) Applicant: CANON KABUSHIKI KAISHA, Tokyo (JP)

(72) Inventors: Ichiro Kanno, Chiba (JP); Takeshi Hashimoto, Ibaraki (JP); Kentaro Kamae, Kanagawa (JP); Hayato Ida, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 134 days.

(21) Appl. No.: 17/117,444

(22) Filed: Dec. 10, 2020

(65) Prior Publication Data

US 2021/0181651 A1 Jun. 17, 2021

(30) Foreign Application Priority Data

Dec. 13, 2019 (JP) ..... 2019-225469

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 9/107*** | (2006.01) |

(52) U.S. Cl.

CPC ..... *G03G 9/08755* (2013.01); *G03G 9/0819* (2013.01); *G03G 9/0823* (2013.01); *G03G 9/08711* (2013.01); *G03G 9/09708* (2013.01); *G03G 9/09716* (2013.01); *G03G 9/107* (2013.01)

(58) Field of Classification Search

CPC ..... G03G 9/08755; G03G 9/0819; G03G 9/0823; G03G 9/08711; G03G 9/09708; G03G 9/09716; G03G 9/107

See application file for complete search history.

(56) References Cited

U.S. PATENT DOCUMENTS

| | | | |
|---|---|---|---|
| 8,084,174 | B2 | 12/2011 | Hasegawa et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,974,994 | B2 | 3/2015 | Kamae et al. |
| 8,986,914 | B2 | 3/2015 | Fujikawa et al. |
| 9,057,970 | B2 | 6/2015 | Ida et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,348,247 | B2 | 5/2016 | Ida et al. |
| 9,348,253 | B2 | 5/2016 | Kanno et al. |
| 9,417,540 | B2 | 8/2016 | Hashimoto et al. |
| 9,436,112 | B2 | 9/2016 | Iwasaki et al. |
| 9,540,483 | B2 | 1/2017 | Ida et al. |
| 9,575,426 | B2 * | 2/2017 | Shimano ..... G03G 9/08795 |
| 9,651,883 | B2 | 5/2017 | Hama et al. |
| 9,665,023 | B2 | 5/2017 | Kamae et al. |
| 9,665,026 | B2 | 5/2017 | Iwasaki et al. |
| 9,696,644 | B2 | 7/2017 | Ida et al. |
| 9,897,934 | B2 | 2/2018 | Tamura et al. |
| 9,915,885 | B2 | 3/2018 | Katsumata et al. |
| 9,969,834 | B2 | 5/2018 | Ohtsu et al. |
| 10,012,918 | B2 | 7/2018 | Ishigami et al. |
| 10,012,920 | B2 | 7/2018 | Shibata et al. |
| 10,012,921 | B2 | 7/2018 | Kamae et al. |
| 10,036,970 | B2 | 7/2018 | Kanno et al. |
| 10,078,281 | B2 | 9/2018 | Ida et al. |
| 10,082,743 | B2 | 9/2018 | Hama et al. |
| 10,088,765 | B2 | 10/2018 | Miyakai et al. |
| 10,133,201 | B2 | 11/2018 | Kamae et al. |
| 10,146,146 | B2 | 12/2018 | Komatsu et al. |
| 10,175,595 | B2 | 1/2019 | Onozaki et al. |
| 10,197,936 | B2 | 2/2019 | Onozaki et al. |
| 10,203,619 | B2 | 2/2019 | Yamashita et al. |
| 10,216,108 | B2 | 2/2019 | Iwasaki et al. |
| 10,228,629 | B2 | 3/2019 | Tamura et al. |
| 10,234,777 | B2 | 3/2019 | Ohtsu et al. |
| 10,274,851 | B2 | 4/2019 | Hashimoto et al. |
| 10,353,312 | B2 | 7/2019 | Kamae et al. |

(Continued)

FOREIGN PATENT DOCUMENTS

| | | |
|---|---|---|
| JP | 2013097321 A | 5/2013 |
| JP | 2017058604 A | 3/2017 |

(Continued)

OTHER PUBLICATIONS

English machine translation of JP 2018194833 A (Year: 2018).*
UCLA Chemistry & Biochemistry, Solvent, May 5, 2016, Polarity Index of Chloroform and Tetrahydrofuran (Year: 2016).*
Robert F. Fedors, "A Method for Estimating Both the Solubility Parameters and Molar Volumes of Liquids", Polymer Engineering and Science, vol. 14, No. 2, 147-154, Feb. 1974.

* cited by examiner

*Primary Examiner* — Peter L Vajda
*Assistant Examiner* — Boone Alexander Evans
(74) *Attorney, Agent, or Firm* — Venable LLP

(57) ABSTRACT

A toner having: a toner particle containing a binder resin including a first resin and a second resin; and an inorganic fine particle on a surface of the toner particle, wherein the first resin has a specific content ratio of a specific monomer unit, acid values of the first unit and second unit are within specific ranges, a domain matrix structure including a matrix containing the first resin and domains containing the second resin appears in cross-sectional observation of the toner, a compound having an alkyl group is present on a surface of the inorganic fine particle, and a volume resistivity of the inorganic fine particle is $1.0\times10^{5}$ Ω·cm to $1.0\times10^{13}$ Ω·cm.

24 Claims, No Drawings

(56) References Cited

U.S. PATENT DOCUMENTS

| | | | |
|---|---|---|---|
| 10,401,748 | B2 | 9/2019 | Hashimoto et al. |
| 10,423,086 | B2 | 9/2019 | Hama et al. |
| 10,423,090 | B2 | 9/2019 | Ohtsu et al. |
| 10,451,986 | B2 | 10/2019 | Sano et al. |
| 10,451,990 | B2 | 10/2019 | Kamae et al. |
| 10,474,049 | B2 | 11/2019 | Onozaki et al. |
| 10,514,624 | B2 | 12/2019 | Tamura et al. |
| 10,564,560 | B2 | 2/2020 | Onozaki et al. |
| 10,599,060 | B2 | 3/2020 | Kanno et al. |
| 10,656,545 | B2 | 5/2020 | Kamae et al. |
| 10,775,710 | B1 | 9/2020 | Kamae et al. |
| 2013/0108955 | A1 | 5/2013 | Shibata et al. |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0329176 | A1 | 11/2014 | Kanno et al. |
| 2015/0099227 | A1 | 4/2015 | Ida et al. |
| 2016/0109820 | A1 | 4/2016 | Hashimoto et al. |
| 2017/0315463 | A1 | 11/2017 | Onozaki et al. |
| 2018/0246430 | A1* | 8/2018 | Tanaka ..... G03G 9/0827 |
| 2018/0275540 | A1 | 9/2018 | Matsuo et al. |
| 2018/0314176 | A1 | 11/2018 | Ikeda et al. |
| 2019/0384193 | A1 | 12/2019 | Hashimoto et al. |
| 2019/0384202 | A1 | 12/2019 | Shirayama et al. |
| 2020/0057397 | A1 | 2/2020 | Murayama et al. |
| 2020/0073263 | A1 | 3/2020 | Hama et al. |
| 2020/0166862 | A1 | 5/2020 | Onozaki et al. |
| 2020/0183295 | A1 | 6/2020 | Kanno et al. |
| 2020/0233327 | A1 | 7/2020 | Honda et al. |
| 2020/0272068 | A1 | 8/2020 | Ochi et al. |
| 2020/0301301 | A1 | 9/2020 | Chimoto et al. |

FOREIGN PATENT DOCUMENTS

| | | | | |
|---|---|---|---|---|
| JP | 2018194833 | A * | 12/2018 | ..... G03G 9/0821 |
| WO | 2019073731 | A1 | 4/2019 | |

TONER AND TWO-COMPONENT DEVELOPER

BACKGROUND OF THE INVENTION

Field of the Invention

The present disclosure relates to a toner for use in electrophotographic systems, electrostatic recording systems, electrostatic printing systems and toner jet systems, and two a two-component developer using the toner.

Description of the Related Art

As electrophotographic full color copiers have proliferated in recent years, there has been increased demand for higher printer speeds and greater energy savings. To achieve high-speed printing, techniques have been studied for melting the toner more rapidly in the fixing step. Techniques have also been studied for reducing the various control times within jobs and between jobs in order to increase productivity. As strategies for saving energy, techniques have been studied for fixing the toner at a lower temperature in order to reduce the energy expenditure in the fixing step.

Methods for achieving high-speed printing while improving the low-temperature fixability of the toner including lowering the glass transition temperature or softening point of the binder resin in the toner, and using a binder resin having a sharp-melt property. In recent years, many toners have been proposed that contain crystalline polyesters as resins having sharp-melt properties. However, crystalline polyesters have problems of charging stability in high-temperature, high-humidity environments, and particularly problems with maintaining charging performance after standing in high-temperature, high humidity environments.

Various toners have also been proposed that use crystalline vinyl resins as other crystalline resins having sharp-melt properties.

For example, Japanese Patent Application Publication No. 2013-097321 proposes a toner that achieves both low-temperature fixability and charge stability by using an acrylate resin having crystallinity.

Japanese Patent Application Publication No. 2017-58604 proposes a toner that achieves both low-temperature fixability and charge uniformity by using a binder resin including an amorphous vinyl resin chemically linked to a crystalline vinyl resin.

Furthermore, WO 2019/073731 proposes a toner using a binder resin that combines a crystalline vinyl resin with a polyester resin crosslinked by carbon-carbon bonds.

SUMMARY OF THE INVENTION

The toners of these patent documents can provide low-temperature fixability, as well as some improvement in charging stability, which has been a weakness of toners using crystalline polyester resins. However, it has been found that these toners using crystalline vinyl resins as binder resins have slow charge rising.

Because of this, it has been found that when an image with a small print percentage is printed immediately after printing an image with a large print percentage, the image density changes gradually due to the difference between the charge quantities of the toner present in the developing device and the new toner supplied to the developing device. This tendency is particularly evident in low-humidity environments.

The present disclosure provides a toner having both low-temperature fixability and hot offset resistance, as well as charge stability in high-temperature, high-humidity environments and rapid charge rising and moreover exhibiting resistance to density fluctuations regardless of the image print percentage, and also provides a two-component developer using the toner.

A toner comprising:

a toner particle containing a binder resin including a first resin and a second resin; and an inorganic fine particle on a surface of the toner particle, wherein the first resin is a crystalline resin, the second resin is an amorphous resin, the first resin has a first monomer unit represented by formula (1) below, a content ratio of the first monomer unit in the first resin is 30.0 mass % to 99.9 mass %, an acid value of the first resin is 0.1 mg KOH/g to 30 mg KOH/g, an acid value of the second resin is 0.5 mg KOH/g to 40 mg KOH/g, a domain matrix structure formed of a matrix containing the first resin and domains containing the second resin appears in cross-sectional observation of the toner, a compound having an alkyl group is present on a surface of the inorganic fine particle, and a volume resistivity of the inorganic fine particle is $1.0\times10^{5}$·cm to $1.0\times10^{13}$ Ω·cm:

in the following formula (1), $R_{Z1}$ represents a hydrogen atom or methyl group, and R represents a $C_{18-36}$ alkyl group.

(1)

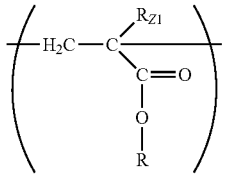

The present disclosure can provide a toner having both low-temperature fixability and hot offset resistance, as well as charge stability in high-temperature, high-humidity environments and rapid charge rising and moreover exhibiting resistance to density fluctuations regardless of the image print percentage.

Further features of the present invention will become apparent from the following description of exemplary embodiments.

DESCRIPTION OF THE EMBODIMENTS

Unless otherwise specified, descriptions of numerical ranges such as "from X to Y" or "X to Y" in the present disclosure include the numbers at the upper and lower limits of the range.

In the present disclosure, a (meth)acrylic acid ester means an acrylic acid ester and/or a methacrylic acid ester.

When numerical ranges are described in stages, the upper and lower limits of each of each numerical range may be combined arbitrarily.

The term "monomer unit" describes a reacted form of a monomeric material in a polymer. For example, one carbon-carbon bonded section in a principal chain of polymerized vinyl monomers in a polymer is given as one unit. A vinyl monomer can be represented by the following formula (Z):

(Z)

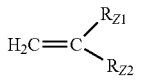

[in formula (Z), $R_{Z1}$ represents a hydrogen atom or alkyl group (preferably a $C_{1-3}$ alkyl group, or more preferably a methyl group), and $R_{Z2}$ represents any substituent].

A crystalline resin is a resin exhibiting a clear endothermic peak in differential scanning calorimetry (DSC) measurement.

The inventors believe that the mechanism that produces the effects of the invention is as follows.

It is thought that the charge rising speed of the toner is determined by the speed with which charge migrates to the toner particle surface from inorganic fine particles on the toner particle surface, and is saturated across the entire toner particle. Conventionally, low-resistivity inorganic fine particles such as titanium oxide have been used to increase the rate of charge transfer from the interior of the inorganic fine particle and thereby increase the charge rising speed of the toner.

However, the inventors' researches have shown that this by itself does not increase the charge rising speed sufficiently when a crystalline vinyl resin is used as the binder resin. This is thought to be because charge transfer from the inorganic fine particle to the toner particle surface is restricted.

As a result of studies into different compositions of binder resins, it was discovered that charge rising is somewhat improved with a crystalline resin using a monomer having an acid value. The inventors believed that with a monomer having an acid value, the charge transfer was faster due to the presence of electric dipoles caused by charge localization. However, with some compositions the low-temperature fixability and hot offset resistance were reduced.

The inventors then discovered as a result of earnest research that these problems could be solved by controlling the states of a crystalline resin and an amorphous resin in the toner, the acid value of the crystalline resin, the acid value of the amorphous resin, and the resistivity and surface treatment of an inorganic fine particle on the toner surface within specific ranges.

In these disclosures, a domain-matrix structure composed of a matrix (sea component) containing a first resin, which is a crystalline resin, and domains (island component) containing a second resin, which is an amorphous resin, is apparent in cross-sectional observation of the toner. When such a domain-matrix structure is formed, the fixing temperature range of the toner can be greatly expanded.

Excellent low-temperature fixability is achieved because the matrix (sea component) is composed of a crystalline resin and the domains (island component) are composed of an amorphous resin in the domain-matrix structure of the toner cross-section.

On the other hand, in the case of a uniform structure in which a crystalline resin and an amorphous resin blend together without forming a domain-matrix structure, low-temperature fixability is reduced because the sharp melt property of the crystalline resin is lost. Moreover, if the toner has a structure in which the matrix is composed of an amorphous resin and the domains are composed of a crystalline resin, the sharp melt property of the crystalline resin is not sufficiently obtained and low-temperature fixability declines because the melting properties are governed by the crystalline resin.

Preferably the matrix is exposed on at least part of the toner particle surface, and at least some of the inorganic fine particles contact the exposed part of the matrix.

The first resin is a crystalline resin having a first monomer unit represented by formula (1).

The content ratio of the first monomer unit in the first resin is 30.0 mass % to 99.9 mass %. The acid value of the first resin is 0.1 mg KOH/g to 30 mg KOH/g. Because the first resin has such a first monomer unit, the binder resin has crystallinity and the low-temperature fixability of the toner is improved.

Low-temperature fixability and charge rising in low-humidity environments are good when the content ratio of the first monomer unit in the first resin is 30.0 mass % to 99.9 mass %.

Low-temperature fixability declines if the content ratio of the first monomer unit is less than 30.0 mass %. The range is more preferably 40.0 mass % to 90.0 mass %, or still more preferably 45.0 mass % to 75.0 mass %. If the content ratio of the first monomer unit exceeds 99.9 mass %, the charge rising performance in low-humidity environments may decline because too much of the first resin may be occupied by non-polar parts with low SP values.

The acid value of the first resin (crystalline resin) is 0.1 mg KOH/g to 30 mg KOH/g. If the acid value is within this range, the charging rising performance of the toner is improved because the toner particle surface receives charge more easily from the inorganic fine particle.

If the acid value of the first resin is less than 0.1 mg KOH/g, the effect of improving the charge rising performance of the toner is not obtained because charge transfer from the inorganic fine particle to the toner particle surface is not smooth. If the acid value of the first resin exceeds 30 mg KOH/g, charge retention may decline in high-humidity environments in particular because the toner particle surface becomes less hydrophobic. More preferably the acid value is in the range of 5 mg KOH/g to 15 mg KOH/g.

(1)

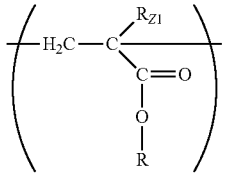

[in formula (1), $R_{Z1}$ represents a hydrogen atom or methyl group, and R represents a $C_{18-36}$ alkyl group (preferably a $C_{18-30}$ linear alkyl group).]

The first monomer unit represented by formula (1) is preferably a monomer unit derived from at least one selected from the group consisting of the (meth)acrylic acid esters having $C_{18-36}$ alkyl groups.

Examples of (meth)acrylic acid esters each having a $C_{18-36}$ alkyl group include (meth)acrylic acid esters each having a $C_{18-36}$ straight-chain alkyl group [stearyl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate, dotriacontyl (meth)acrylate, etc.] and (meth)acrylic acid esters each having a $C_{18-36}$ branched alkyl group [2-decyltetradecyl (meth)acrylate, etc.].

Of these, at least one selected from the (meth)acrylic acid esters having $C_{18-36}$ linear alkyl groups is preferred, at least one selected from the (meth)acrylic acid esters having $C_{18-30}$ linear alkyl groups is more preferred, and at least one selected from linear stearyl (meth)acrylate and behenyl (meth)acrylate is still more preferred from the standpoint of the low-temperature fixability, charge rising performance and charge stability of the toner.

One kind of monomer alone or a combination of at least two kinds of monomers may be used to form the first monomer unit.

The first resin is preferably a vinyl polymer. The vinyl polymer may for example be a polymer of a monomer containing ethylenically unsaturated bonds. An ethylenically unsaturated bond is a radical polymerizable carbon-carbon double bond, and examples include vinyl, propenyl, acryloyl and methacryloyl groups and the like.

The first resin preferably has a second monomer unit that is different from the first monomer unit and is at least one selected from the group consisting of the monomer units represented by formula (2) below and the monomer units represented by formula (3) below.

The content ratio of the second monomer unit in the first resin is preferably 1.0 mass % to 70.0 mass %, or more preferably 10.0 mass % to 60.0 mass %, or still more preferably 15.0 mass % to 30.0 mass %.

(2)

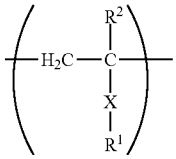

(3)

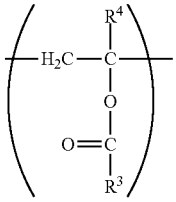

(In formula (2), X represents a single bond or $C_{1-6}$ alkylene group, $R^1$ represents a nitrile group (—C≡N), amido group (—C(═O)NHR$^{10}$ (in which R$^{10}$ represents a hydrogen atom or $C_{1-4}$ alkyl group)), hydroxy group, —COOR$^{11}$ (in which R$^{11}$ represents a $C_{1-6}$ (preferably $C_{1-4}$) alkyl group or $C_{1-6}$ (preferably $C_{1-4}$) hydroxyalkyl group), urea group (—NH—C(═O)—N(R$^{13}$)$_2$ (in which of two R$^{13}$s independently represents a hydrogen atom or $C_{1-6}$ (preferably $C_{1-4}$) alkyl group)), —COO(CH$_2$)$_2$NHCOOR$^{14}$ (in which R$^{14}$ represents a $C_{1-4}$ alkyl group) or —COO(CH$_2$)$_2$—NH—C(═O)—N(R$^{15}$) (in which of two R$^{15}$'s independently represents a hydrogen atom or $C_{1-6}$ (preferably $C_{1-4}$)alkyl group), and $R^2$ represents a hydrogen atom or methyl group.)

(In formula (3), $R^3$ represents a $C_{1-4}$ alkyl group and $R^4$ represents a hydrogen atom or methyl group.)

Given $SP_{21}$ as the SP value $(J/cm^3)^{0.5}$ of the second monomer unit, $SP_{21}$ is preferably at least 21.00 from the standpoint of charging performance, or more preferably at least 25.00. There is no particular upper limit, but preferably it is not more than 40.00, or more preferably not more than 30.00.

If the SP value of the second monomer unit is within this range, charge transfer from the inorganic fine particle occurs rapidly, and the charge rising speed of the toner is increased.

The content of the first resin (crystalline resin) in the binder resin is preferably at least 30.0 mass %.

Within this range, both low-temperature fixability and hot offset resistance can be achieved because it is easy to form a domain-matrix structure comprised of a matrix containing the first resin and domains containing the second resin. The content is more preferably at least 50.0 mass %, or still more preferably at least 55.0 mass %.

There is no particular upper limit, but preferably it is not more than 97.0 mass %, or more preferably not more than 75.0 mass %.

The content of the second resin (amorphous resin) in the binder resin is preferably at least 3.0 mass %, or more preferably at least 25.0 mass %. The upper limit is preferably not more than 70.0 mass %, or more preferably not more than 50.0 mass %, or still more preferably not more than 40.0 mass %.

One feature is that the acid value of the second resin (amorphous resin) is 0.5 mg KOH/g to 40 mg KOH/g. Within this range, the toner particle surface receives charge easily from the inorganic fine particle, and the charge rising performance of the toner is improved.

If the acid value of the second resin is less than 0.5 mg KOH/g, the effect of improving the charging rising performance of the toner is not obtained because charge transfer from the inorganic fine particle to the toner particle surface is not smooth. If the acid value of the second resin exceeds 40 mg KOH/g, charge retention may decline in high-humidity environments in particular because the toner particle surface is less hydrophobic. The acid value is more preferably 1 mg KOH/g to 30 mg KOH/g, or still more preferably 6 mg KOH/g to 25 mg KOH/g, or yet more preferably from 3 mg KOH/g to 20 mg KOH/g.

Examples of the second resin include the following resins: monopolymers of styrenes and substituted styrenes, such as poly-p-chlorostyrene and polyvinyl toluene; styrene copolymers such as styrene-p-chlorostyrene copolymer, styrene-vinyl toluene copolymer, styrene-vinyl naphthaline copolymer, styrene-acrylic acid ester copolymers, styrene-methacrylic acid ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin and petroleum-based resins.

Of these, from the standpoint of the charge rising performance the second resin is preferably at least one selected from the group consisting of the vinyl resins (such as styrene copolymers), polyester resins, and hybrid resins comprising vinyl resins linked to polyester resins. Linked here may mean linked by covalent bonds. The second resin more preferably contains a polyester resin, and still more preferably is a polyester resin.

The second resin is explained below using the example of a polyester resin.

The polyester resin is preferably a condensation polymer of an alcohol component and a carboxylic acid component.

The acid value of the second resin can be controlled for example by varying the contents and types of the alcohol units and carboxylic acid units in the amorphous resin.

An alcohol unit in the second resin is a structure obtained by condensation polymerization of a monomer that is an alcohol component, or in other words is a monomer unit derived from an alcohol component. Moreover, a carboxylic acid unit in the second resin is a structure obtained by condensation polymerization of a monomer that is a carboxylic acid component, or in other words is a monomer unit derived from a carboxylic acid component.

From the standpoint of the charge rising performance, a structure obtained by condensation polymerization of a bisphenol A alkylene oxide adduct preferably constitutes at least 75 mol %, or more preferably at least 80 mol %, or still more preferably at least 90 mol % of the alcohol units. An example of a bisphenol A alkylene oxide adduct is a compound represented by formula (A) below:

(A)

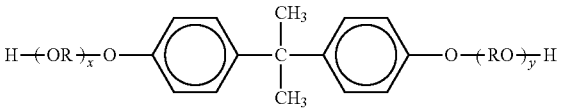

(in formula (A), each R is independently an ethylene or propylene group, each of x and y is 0 or an integer of at least 0, and the average value of x+y is from 0 to 10).

Considering the charge rising performance, the bisphenol A alkylene oxide adduct is preferably a bisphenol A propylene oxide adduct and/or ethylene oxide adduct, and more preferably is a propylene oxide adduct. The average value of x+y is preferably from 1 to 5, and more preferably from 1.6 to 2.8.

The following polyhydric alcohol components may be used as components other than the bisphenol A alkylene oxide adduct for forming the alcohol units:

ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,4,5-pentanetriol, glycerin, 2-methylpropantriol, 2-methyl-1,2,4-butanetriol, trimethylol ethane, trimethylol propane, 1,3,5-trihydroxymethyl benzene.

From the standpoint of low-temperature fixability and hot offset resistance, the peak molecular weight Mp of the second resin is preferably 3,000 to 30.000, or more preferably 5,000 to 20,000, or still more preferably 10,000 to 15,000.

The carboxylic acid units preferably include at least one selected from the group consisting of the aromatic dicarboxylic acid polycondensation structures, saturated aliphatic dicarboxylic acid polycondensation structures and unsaturated dicarboxylic acid polycondensation structures.

Examples of aromatic dicarboxylic acids include phthalic acid, isophthalic acid and terephthalic acid, and their anhydrides.

Alkyldicarboxylic acids such as oxalic acid, malonic acid, succinic acid, adipic acid, suberic acid, azelaic acid and sebacic acid and their anhydrides are desirable as saturated aliphatic dicarboxylic acids from the standpoint of charge rising performance.

Unsaturated dicarboxylic acids such as fumaric acid, maleic acid, citraconic acid, itaconic acid and succinic acid substituted with $C_{6-18}$ alkenyl groups, and anhydrides of these, are desirable as unsaturated dicarboxylic acids. It is especially desirable to include dodecenylsuccinic acid. It is more desirable to combine at least two of the above saturated aliphatic dicarboxylic acids and unsaturated dicarboxylic acids.

That is, preferably the second resin is a polyester resin, and the polyester resin has a polycondensation structure of dodecenylsuccinic acid or its anhydride. Moreover, the polyester resin preferably has a polycondensation structure of another carboxylic acid component in addition to the polycondensation structure of dodecenylsuccinic acid or its anhydride. If the polyester resin has a polycondensation structure of dodecenylsuccinic acid or its anhydride, interactions with the inorganic fine particle are more likely, resulting in good charge rising performance of the toner.

The content of the polycondensation structure of the dodecenylsuccinic acid or anhydride thereof in the carboxylic acid units is preferably 10 mol % to 30 mol %, or more preferably 15 mol % to 20 mol %.

Considering the charge rising performance and hot offset resistance, the carboxylic acid units preferably include a polycondensation structure of an aromatic tricarboxylic acid or aromatic tetracarboxylic acid.

Examples of the aromatic tricarboxylic acid include trimellitic acid and trimellitic anhydride. Examples of aromatic tetracarboxylic acids include pyromellitic acid and pyromellitic anhydride.

The polycondensation structure of the aromatic carboxylic acid preferably constitutes 50 mol % to 80 mol %, or more preferably 60 mol % to 75 mol % of the carboxylic acid units.

Increasing the content ratio of aromatic carboxylic acids relative to aliphatic dicarboxylic acids is desirable for improving charge retention.

Examples of aromatic carboxylic acids include the aforementioned aromatic dicarboxylic acids, aromatic tricarboxylic acids and aromatic tetracarboxylic acids.

Other carboxylic acids for forming the carboxylic acid units include succinic acid or its anhydride substituted with $C_{6-18}$ alkyl groups, and polyvalent carboxylic acids such as 1,2,3,4-butanetetracarboxylic acid and benzophenonetetracarboxylic acid and their anhydrides.

The amorphous polyester resin can be manufactured using any commonly used catalysts, including metals such as tin, titanium, antimony, manganese, nickel, zinc, lead, iron, magnesium, calcium and germanium and compounds containing these metals.

Of these, a tin compound is desirable for improving charging performance. Examples of tin compounds include organic tin compounds such as dibutyl tin dichloride, dibutyl tin oxide, diphenyl tin oxide and the like. An organic tin compound here is a compound having Sn—C bonds.

An inorganic tin compound having no Sn—C bonds can also be used favorably. An inorganic tin compound here is a compound having no Sn—C bonds.

Examples of inorganic tin compounds include non-branched tin alkylcarboxylates such as tin diacetate, tin dihexanoate, tin dioctanoate and tin distearate, branched tin alkylcarboxylates such as tin dineopentylate and tin di(2-ethylhexanoate), tin carboxylates such as tin oxalate, and dialkoxytins such as dioctyloxytin and distearoxytin.

Of these tin compounds, a tin alkylcarboxylate or dialkoxytin is preferred, and tin dioctanoate, tin di(2-ethylhexanoate) and tin distearate, which are tin alkylcarboxylates having carboxyl residues in the molecule, are especially desirable.

The dielectric constant of the second resin (amorphous resin) at 2 kHz is preferably 2.0 pF/m to 3.0 pF/m. Within this range, the charge rising performance is improved because charge transfer with the inorganic fine particle is improved. 2.2 pF/m to 2.8 pF/m is more preferred. The dielectric constant of the second resin can be controlled by changing the monomer composition and acid value.

The binder resin preferably contains a third resin. The third resin preferably contains a resin comprising the first resin (crystal resin) linked to the second resin (amorphous resin), and more preferably is a resin comprising the first resin linked to the second resin. Good charge rising performance, low-temperature fixability and hot offset resistance are obtained when such a third resin is included. The third resin preferably has a structure in which at least parts of the first resin and second resin are linked together for example.

Methods of linking the first resin to the second resin include methods of crosslinking by applying a radical initiator to a mixture obtained by melting or fusing the first resin and second resin, and methods of crosslinking using a crosslinking agent having a functional group that reacts with both the first resin and the second resin and the like.

The radical initiator used in the methods of crosslinking using a radical initiator is not particularly limited, and may be an inorganic peroxide, organic peroxide, azo compound or the like. These radical reaction initiators may also be combined.

When both the first resin and the second resin have carbon-carbon unsaturated bonds, these bonds are cleaved when the first resin and second resin are crosslinked. When either or both of the first resin and second resin have no carbon-carbon unsaturated bonds, the two are crosslinked by extracting hydrogen atoms bonded to carbon atoms contained in the first resin and/or second resin. In this case, the radical initiator is more preferably an organic peroxide having strong hydrogen extraction ability.

The crosslinking agent having a functional group that reacts with both the first resin and the second resin is not particularly limited, and a known agent may be used, such as a crosslinking agent having an epoxy group, a crosslinking agent having an isocyanate groups, a crosslinking agent having an oxazoline group, a crosslinking agent having a carbodiimide group, a crosslinking agent having a hydrazide group, a crosslinking agent having an aziridine group or the like.

In methods of crosslinking using a crosslinking agent having a functional group that reacts with both the first resin and the second resin, both the first and second resin must have functional groups that react with the crosslinking agent.

A resin in which at least parts of the first resin and second resin crosslinked by the above method are linked together (that is, a resin composition containing the first resin and the second resin, and a third resin obtained by crosslinking the first and second resin) may be used to manufacture a toner.

When the toner is manufactured by a melt kneading method, a toner particle containing a resin comprising the first resin linked to the second resin can be manufactured by melt kneading a raw material mixture containing the first and second resin in the presence of the above radical initiator or crosslinking agent.

The content of the third resin in the binder resin is preferably 1.0 mass % to 20.0 mass %, or more preferably from 5.0 mass % to 15.0 mass %.

For example, the third resin is preferably a resin obtained by adding a radical reaction initiator while melt kneading an amorphous polyester resin having carbon-carbon double bonds (second resin) with the first resin to thereby perform a crosslinking reaction.

When the third resin is manufactured using the first resin and second resin, at least parts of the first resin and second resin link together to form the third resin. This yields a binder resin containing the first resin, the second resin and the third resin.

A binder resin containing the first resin, the second resin and the third resin can also be obtained by linking at least parts of the first resin and second resin. The binder resin can also be obtained by manufacturing the third resin separately and then mixing it with the first resin and second resin.

The radical reaction initiator used for this crosslinking reaction is not particularly limited, and may be an inorganic peroxide, organic peroxide, azo compound or the like. These radical reaction initiators may also be combined.

The inorganic peroxide is not particularly limited, and examples include hydrogen peroxide, ammonium peroxide, potassium peroxide, sodium peroxide and the like.

The organic peroxide is not particularly limited, and examples include benzoyl peroxide, di-t-butyl peroxide, t-butylcumyl peroxide, dicumyl peroxide, α,α-bis(t-butylperoxy)diisopropyl benzene, 2,5-dimethyl-2,5-bis(t-butylperoxy) hexane, di-t-hexyl peroxide, 2,5-dimethyl-2,5-di-t-butylperoxyhexine-3, acetyl peroxide, isobutyryl peroxide, octanoyl peroxide, decanoyl peroxide, lauroyl peroxide, 3,3,5-trimethylhexanoyl peroxide, m-toluyl peroxide, t-butyl peroxyisobutyrate, t-butyl peroxyncodecanoate, cumyl peroxyneodecanoate, t-butyl peroxy-2-ethylhexanoate, t-butylperoxy-3,5,5-trimethylhexanoate, t-butyl peroxylaurate, t-butyl peroxybenzoate, t-butyl peroxyisopropyl monocarbonate, t-butyl peroxyacetate and the like.

The azo compound or diazo compound is not particularly limited, and examples include 2,2'-azobis-(2,4-dimethylvaleronitrile), 2,2'-azobisisobutyronitrile, 1,1'-azobis(cyclohexan-1-carbonitrile). 2,2,'-azobis-4-methoxy-2,4-dimethylvaleronitrile, azobisisobutyronitrile and the like.

Of these, an organic peroxide is desirable because it has high initiator efficiency and does not produce toxic byproducts such as cyan compounds.

A reaction initiator with high hydrogen extraction ability is desirable because the crosslinking reaction can proceed efficiency with a smaller amount of the initiator, and a radical reaction initiator with high hydrogen extraction ability such as t-butylperoxyisopropyl monocarbonate, benzoyl peroxide, di-t-butyl peroxide, t-butylcumyl peroxide, dicumyl peroxide, α,α-bis(t-butylperoxy)diisopropyl benzene, 2,5-dimethyl-2,5-bis(t-butylperoxy) hexane or di-t-hexylperoxide is even more desirable.

The amount of the radical reaction initiator used is not particularly limited, but is preferably 0.1 to 50 mass parts, or more preferably 0.2 to 5 mass parts per 100 mass parts of the binder resin to be crosslinked.

From the standpoint of low-temperature fixability, hot offset resistance and charge rising performance, the mass ratio X/Y of the content X of the first resin to the content Y of the second resin in the binder resin is preferably 0.2 to 2.5, or more preferably 2.0 to 2.4.

From the standpoint of low-temperature fixability and hot offset resistance, the number-average diameter of the domains in cross-sectional observation of the toner is preferably 0.1 μm to 2.0 μm, or more preferably 0.5 μm to 1.5 μm.

If the number-average diameter of the domains is not more than 2.0 μm, fixing performance is improved because the crystalline resin of the matrix and the amorphous resin of the domains melt more easily when the toner particle is fixed. Moreover, hot offset is suppressed because the viscosity of the melted matrix is maintained at an appropriate level in high-temperature regions.

If the number-average diameter of the domains is at least 0.1 μm, low-temperature fixability is improved because the sharp melt property of the crystalline resin can be properly obtained.

The number-average diameter of the domains can be controlled by means of the monomer compositions and manufacturing conditions of the crystalline resin and amorphous resin and the like.

The toner is characterized by containing an inorganic fine particle with a volume resistivity of $1.0\times10^{5}$ Ω·cm to $1.0\times10^{13}$ Ω·m.

If the volume resistivity of the inorganic fine particle is within this range, charge transfer within the inorganic fine particle occurs more rapidly, and charge rising is improved. If the volume resistivity is less than $1.0\times10^{5}$ Ω·m, the charging properties are reduced in high-temperature, high-humidity environments because the resistivity is too low. If it exceeds $1.0\times10^{13}$ Ω·cm, on the other hand, charge rising is slow due to the high resistance.

The volume resistivity of the inorganic fine particle is preferably $1.0\times10^{8}$ Ω·cm to $7.0\times10^{12}$ Ω·cm. The volume resistivity can be controlled by controlling the type of inorganic fine particle, the type of surface treatment, the concentration of the surface treatment agent and the like.

the following are examples of inorganic fine particles with volume resistivities of $1.0\times10^{5}$ Ω·cm to $1.0\times10^{13}$ Ω·cm:

fine particles of metal titanate salts such as strontium titanate fine particles, calcium titanate fine particles and magnesium titanate fine particles; and fine particles of metal oxides such as titanium oxide fine particles, magnesium oxide fine particles, zinc oxide fine particles and cerium oxide fine particles.

Of these, at least one selected from the group consisting of the titanium oxide fine particles, strontium titanate fine particles, calcium titanate fine particles and zinc oxide fine particles is preferred. At least one selected from the group consisting of the titanium oxide fine particles and strontium titanate fine particles is more preferred. Still more preferably the inorganic fine particles include titanium oxide fine particles, and yet more preferably the inorganic fine particles are titanium oxide fine particles.

The properties of the particles such as particle size, resistivity and dielectric constant are relatively easy to control by means of the manufacturing conditions. The strontium titanate preferably has a perovskite crystal structure. Electron transfer with the second monomer unit is relatively rapid if the strontium titanate has a perovskite crystal structure.

Strontium titanate fine particles, calcium titanate fine particles and magnesium titanate fine particles can be obtained for example by an atmospheric heating reaction method. In this case, a mineral acid peptized product of a hydrolyzed titanium compound is used as the titanium oxide source, and a water-soluble acidic metal compound is used as the metal oxide source. Manufacturing can be performed by reacting a mixture of these while adding an alkaline aqueous solution at 60° C. or more, and then treating with an acid.

The method for manufacturing the titanium oxide fine particle is not particularly limited, and examples include titania fine particles produced by conventional sulfuric acid methods and chlorine methods, and titania fine particles produced by vapor-phase oxidation methods in which titanium tetrachloride as a raw material is reacted with oxygen in a vapor phase. A titania fine particle obtain by a sulfuric acid method is more preferred because it is easy to control the number-average particle diameter of the primary particles of the resulting titania fine particle.

For the titania fine particle, it is desirable to use either of two crystal forms, rutile and anatase. To obtain an anatase type titanium oxide fine particle, it is desirable to add phosphoric acid, a phosphate salt or a potassium salt or the like as a rutile transition inhibitor when baking metatitanic acid.

To obtain a rutile type titanium oxide fine particle, on the other hand, it is desirable to add a salt such as a lithium salt, magnesium salt, zinc salt or aluminum salt as a rutile transition promoter, or a seed such as a slurry containing rutile fine crystals.

Methods of manufacturing metal oxide fine particles of magnesium oxide, zinc oxide and cerium oxide include dry methods of oxidizing metal vapor in air to produce zinc oxide, and wet methods in which metal salts are neutralized by reacting then with alkali in aqueous solution, then water washed, dried, and baked to produce zinc oxide. Of these, synthesis by a wet method is preferred because it is more likely to yield a fine particle with a relatively small particle diameter that can be added to the toner surface.

The dielectric constant of the inorganic fine particle at 2 kHz is preferably 20 pF/m to 60 pF/m. An inorganic fine particle with a dielectric constant within this range is desirable because it undergoes rapid charge transfer with the second monomer unit. It is thought that because this dielectric constant derives from polarization within or between atoms, it is closely associated with charge transfer.

The dielectric constant can be controlled by selecting the inorganic fine particle, or by controlling the conditions and operations to after the particle crystallinity when manufacturing the inorganic fine particle, such as by altering the reaction temperature or water pressure in a dry method or the pi or temperature in a wet method, or by ultrasound treatment, bubbling treatment or the like during crystal formation for example.

The dielectric constant is more preferably 20 pF/m to 40 pF/m, or still more preferably 25 pF/m to 30 pF/m.

A compound having an alkyl group is present on the surface of the inorganic fine particle. Such an inorganic fine particle can be obtained for example by surface treating the inorganic fine particle with a compound having an alkyl group.

If the inorganic fine particle has a compound having an alkyl group on its surface, it can interact with the alkyl group contained in the first monomer unit, improving adhesiveness and allowing charge to be transferred rapidly from the inorganic fine particle to the second monomer unit of the toner particle.

Examples of compounds having alkyl groups include fatty acids, fatty acid metal salts, silicone oils, silane coupling agents, titanium coupling agents and fatty alcohols.

Of these, at least one compound selected from the group consisting of the fatty acids, fatty acid metal salts, silicone oils and silane coupling agents is preferred for easily obtaining the effects of the present disclosure.

Examples of fatty acids and fatty acid metal salts include lauric acid, stearic acid, behenic acid, lithium laurate, lithium stearate, sodium stearate, zinc laurate, zinc stearate, calcium stearate and aluminum stearate.

The following are methods for surface treating the inorganic fine particle with a fatty acid or metal salt thereof. For example, a slurry containing the inorganic fine particle can be placed in fatty acid sodium aqueous solution in an Ar gas or $N_2$ gas atmosphere, and the fatty acid precipitated on the perovskite crystal surface. A slurry containing the inorganic fine particle can also be placed in a fatty acid sodium aqueous solution in an Ar gas or $N_2$ gas atmosphere, and an aqueous solution of a desired metal salt added dropwise under stirring to precipitate and adsorb a fatty acid metal salt on the perovskite crystal surface. For example, aluminum stearate can be adsorbed by using aluminum sulfate with a sodium stearate aqueous solution.

Examples of silicone oils include dimethyl silicone oil, methyl phenyl silicone oil, and alkyl modified silicone oils such as alpha-methylstyrene modified silicone oil and octyl modified silicone oil.

The method of silicone oil treatment may be a known method. For example, the inorganic fine particle and silicone oil can be mixed with a mixer; or the silicone oil can be sprayed with a sprayer onto the inorganic fine particle; or the silicone oil can be dissolved in a solvent, after which the inorganic fine particle is mixed in. The treatment method is not limited to these.

Examples of silane coupling agents include hexamethyl disilazane, trimethyl silane, trimethyl ethoxysilane, isobutyl trimethoxysilane, trimethyl chlorosilane, dimethyl dichlorosilane, methyl trichlorosilane, dimethyl ethoxysilane, dimethyl dimethoxysilane, octyl trimethoxysilane, decyl trimethoxysilane, cetyl trimethoxysilane and stearyl trimethoxysilane.

Examples of fatty alcohols include ethanol, n-propanol, 2-propanol, n-butanol, t-butanol, n-octanol, stearyl alcohol and 1-tetracosanol. The method of treatment with the fatty alcohol may be for example a method of treating the inorganic fine particle after heating and vaporizing at a temperature at or above the boiling point.

Of these compounds, at least one compound selected from the group consisting of the compounds having $C_{4-24}$ (preferably $C_{4-18}$) alkyl groups is desirable for improving the charge rising because it further improves interactions with the alkyl groups of the first monomer unit.

The compound having an alkyl group preferably has a structure represented by $(R^9—COO)_pM(O)_q$ (in which each $R^9$ independently represents a $C_{4-24}$ (preferably $C_{4-18}$) linear or branched alkyl group or a $C_{4-24}$ (preferably $C_{4-18}$) linear or branched hydroxyalkyl group, M is Al, Zn, Mg, Ca, Sr, K or Na (preferably Ca or Na), p is an integer from 1 to 3 (preferably 1 or 2) and q is an integer from 0 to 2 (preferably 0)).

Given Cx as the carbon number of the alkyl group represented by R in the first monomer unit and Cy as the carbon number of the alkyl group of the compound having an alkyl group, Cx/Cy is preferably 0.8 to 24.0 in order to further strengthen interactions between alkyl groups and allow for smooth charge transfer. 1.0 to 7.0 is more preferable. When using multiple first monomer units or multiple compounds having alkyl groups, the average carbon number is calculated based on the molar ratio.

Given Cz as the carbon number of the polyvalent carboxylic acid in the polymerized (preferably polycondensed) structure of a polyvalent carboxylic acid contained in the second resin (amorphous resin). (Cx+Cz)/Cy is preferably 0.8 to 10.0. Within this range, interactions between alkyl groups become stronger, and charge transfer occurs smoothly. 1.0 to 5.0 is more preferable, and 1.0 to 3.0 is still more preferable.

When using multiple first monomer units or multiple compounds having alkyl groups, the average carbon number is calculated based on the molar ratio.

The number-average particle diameter of the primary particles of the inorganic fine particle is preferably 20 nm to 300 nm. A number-average primary particle diameter within this range is desirable because it makes it easier for the inorganic fine particles to interact with both the first and second monomer units of the first resin having a block copolymer-like structure. 20 nm to 200 nm is more preferable.

The content of the inorganic fine particle is preferably from 0.1 to 15.0 mass parts per 100 mass parts of the toner particle.

The coverage ratio of the toner particle by the inorganic fine particle is preferably 10 area % to 80 area % to more easily obtain the effects of the present disclosure. More preferably it is 15 area % to 75 area %, or still more preferably 20 area % to 70 are %. The coverage ratio can be controlled by controlling the added amount of the inorganic fine particle, the external addition conditions and the like.

The charge decay rate coefficient of the toner as measured in a 30° C., 80% RH environment is preferably 3 to 100, or more preferably 3 to 50. A charge decay rate coefficient within this range is desirable for controlling loss of charge in high-temperature, high-humidity environments. The charge decay rate coefficient can be controlled by controlling the type and acid value of the binder resin, the type of inorganic fine particle, the inorganic fine particle surface treatment agent, and the coverage ratio of the toner particle by the inorganic fine particle.

Given Xε as the dielectric constant of the inorganic fine particle at 2 kHz and Yε as the dielectric constant of the second resin at 2 kHz, Xε/Yε is preferably 5.0 to 170.0.

Within this range, charge up can be controlled in low-temperature low-humidity environments. Xε/Yε is more preferably from 8.0 to 13.0.

The first resin (crystalline resin) may also contain a third monomer unit different from the first monomer unit represented by formula (1) above and the second monomer unit represented by formula (2) or (3) above.

Polymerizable monomers capable of forming the third monomer unit include styrenes such as styrene and o-methylstyrene, and their derivatives, (meth)acrylic acid esters such as 2-ethylhexyl (meth)acrylate, and (meth)acrylic acid.

The content ratio of the third monomer unit in the first resin is preferably 1.0 mass % to 30.0 mass %, or more preferably 5.0 mass % to 20.0 mass %.

As discussed above, a strontium titanate fine particle can be obtained by an atmospheric heating reaction method.

Atmospheric Heating Reaction Method

A mineral acid peptized product of a hydrolyzed titanium compound is used as the titanium oxide source. For example, metatitanic acid with an $SO_3$ content of preferably not more than 1.0 mass % or more preferably not more than 0.5 mass % obtained by the sulfuric acid method that has been peptized by adjusting the pH to 0.8 to 1.5 with hydrochloric acid can be used.

A nitrate salt, hydrochloride salt or the like may be used as the strontium oxide source, and for example strontium nitrate or strontium hydrochloride may be used.

A caustic alkali may be used for the alkaline aqueous solution, and a sodium hydroxide aqueous solution is preferred.

Factors that affect the particle diameter of the resulting strontium titanate particle include the mixing ratios of the titanium oxide source and strontium oxide source in the reaction, the concentration of the titanium oxide source at the beginning of the reaction, and the temperature and addition rate when adding the alkaline aqueous solution, and these can be adjusted appropriately to obtain the target particle diameter and particle size distribution. It is desirable to prevent contamination by carbon dioxide gas during the reaction process by for example performing the reaction in a nitrogen gas atmosphere to prevent production of carbonate.

Factors that affect the dielectric constant of the resulting strontium titanate particle include conditions and operations that disrupt the particle crystallinity. To obtain a strontium titanate with a low dielectric constant, energy is preferably applied to disrupt crystal growth with the reaction solution at a high concentration, and one specific method is to apply microbubbling with nitrogen during the crystal growth process for example.

For the mixing ratios of the titanium oxide source and strontium oxide source during the reaction, the molar ratio of $SrO/TiO_2$ is preferably 0.9 to 1.4, or more preferably 1.05 to 1.20. If the $SrO/TiO_2$ molar ratio is not less than 0.9, there is less likely to be residual unreacted titanium oxide. The concentration of the titanium oxide source at the beginning of the reaction preferably be 0.05 to 1.3 mol/L, or more preferably be 0.08 to 1.0 mol/L as $TiO_2$.

The temperature when adding the alkaline aqueous solution is preferably about 60° C. to 100° C. Regarding the addition rate of the alkaline aqueous solution, a slower addition rate produces a metal titanate particle with a larger particle diameter, and a faster addition rate produces a metal titanate particle with a smaller particle diameter. The addition rate of the alkaline aqueous solution is preferably 0.001 to 1.2 eq/h or more preferably 0.002 to 1.1 eq/h relative to the raw materials, and can be adjusted appropriately according to the desired particle diameter.

Acid Treatment

Preferably the metal titanate particle obtained by the atmospheric heating reaction is further acid treated. When synthesizing the metal titanate particle by an atmospheric heating reaction, if the mixing ratio of the titanium oxide source and strontium oxide source exceeds a $SrO/TiO_2$ molar ratio of 1.0, metal sources other than unreacted titanium remaining after completion of the reaction may react with carbon dioxide gas in the air, producing impurities such as metal carbonate salts. Consequently, acid treatment is preferably performed after addition of the alkaline aqueous solution to remove unreacted metal sources.

In the acid treatment, the pH is preferably adjusted to 2.5 to 7.0 or more preferably to 4.5 to 6.0 with hydrochloric acid. In addition to hydrochloric acid, nitric acid, acetic acid and the like may also be used as acids.

Colorant

The toner may also use a colorant. Examples of colorants include the following.

Examples of black colorants include carbon black and blacks obtained by blending yellow, magenta and cyan colorants. A pigment may be used alone as a colorant, but combining a dye and a pigment to improve the sharpness is desirable from the standpoint of the image quality of full-color images.

Examples of pigments for magenta toners include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. pigment violet 19; and C.I. vat red 1, 2, 10, 13, 15, 23, 29 and 35.

Examples of dyes for magenta toners include C.I. solvent red 1, 3, 8, 23, 24, 25, 27, 30, 49, 81, 82, 83, 84, 100, 109 and 121; C.I. disper red 9; C.I. solvent violet 8, 13, 14, 21, 27; oil-soluble dyes such as C.I. disperse violet 1, and C.I. basic red 1, 2, 9, 12, 13, 14, 15, 17, 18, 22, 23, 24, 27, 29, 32, 34, 35, 36, 37, 38, 39 and 40; and basic dyes such as C.I. basic violet 1, 3, 7, 10, 14, 15, 21, 25, 26, 27 and 28.

Examples of pigments for cyan toners include C.I. pigment blue 2, 3, 15:2, 15:3, 15:4, 16, and 17; C.I. vat blue 6; and C.I. acid blue 45 and copper phthalocyanine pigments having 1 to 5 phthalimidomethyl substituents in the phthalocyanine framework.

Examples of dyes for cyan toners include C.I. solvent blue 70.

Examples of pigments for yellow toners include C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. vat yellow 1, 3 and 20.

Examples of dyes for yellow toners include C.I. solvent yellow 162.

The content of the colorant is preferably from 0.1 to 30 mass parts per 100 mass parts of the binder resin.

Wax

A wax may also be used in the toner. Examples of the wax include the following: hydrocarbon waxes such as microcrystalline wax, paraffin wax and Fischer-Tropsch wax; oxides of hydrocarbon waxes, such as polyethylene oxide wax, and block copolymers of these; waxes such as carnauba wax consisting primarily of fatty acid esters; and waxes such as deoxidized carnauba wax consisting of partially or fully deoxidized fatty acid esters.

Other examples include the following: saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, ceryl alcohol and melissyl alcohol; fatty acid amides such as linoleamide, oleamide and lauramide; saturated fatty acid bisamides such as methylene bis stearamide, ethylene bis capramide, ethylene bis lauramide and hexamethylene bis stearamide; unsaturated tatty acid amides such as ethylene bis oleamide, hexamethylene bis oleamide, N,N'-dioleyl adipamide and N,N'-dioleyl sebacamide; aromatic bisamides such as m-xylene bis stearamide and N,N'-distearyl isophthalamide; aliphatic metal salts (commonly called metal soaps) such as calcium stearate, calcium laurate, zinc stearate and magnesium stearate; waxes obtained by grafting vinyl monomers such as styrene and acrylic acid onto aliphatic hydrocarbon waxes; partial esterification products of polyhydric alcohols and tatty acids, such as behenic acid monoglyceride; and methyl ester compounds having hydroxy groups obtained by hydrogenation of plant-based oils and fats.

The content of the wax is preferably 2.0 to 30.0 mass parts per 100 mass parts of the binder resin.

Charge Control Agent

A charge control agent may also be included in the toner as necessary. A known charge control agent may be included in the toner, and a metal compound of an aromatic carboxylic acid is especially desirable because it is colorless and can provide a rapid charging speed and stably maintain a uniform charge quantity.

Examples of negative charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes. The charge control agent may be added either internally or externally to the toner particle.

The added amount of the charge control agent is preferably 0.2 to 10 mass parts per 100 mass parts of the binder resin.

Inorganic Fine Power

In addition to the inorganic fine particle described above, another inorganic fine powder may be included in the toner as necessary. The inorganic fine powder may be added either internally or externally to the toner particle. An inorganic fine powder such as silica is desirable as an external additive. Preferably the inorganic fine powder is one that has been hydrophobically treated with a hydrophobic agent such as a silane compound or silicone oil or a mixture of these.

For example, it is desirable to use a silica fine powder produced by any method, such a precipitation method, sol-gel method or other wet method for obtaining silica by neutralizing sodium silicate, or a flame melting method, are method or other dry method for obtaining silica in a vapor phase. Of these, a silica fine powder produced by a sol-gel method or flame melting method is more desirable because it makes it easier to control the number-average particle diameter of the primary particle within the desired range.

An inorganic fine powder with a specific surface area of from 50 $m^2/g$ to 400 $m^2/g$ is desirable as an external additive for improving flowability, while an inorganic fine powder with a specific surface area of from 10 m/g to 50 n/g is desirable for stabilizing durability. To both improve flowability and stabilize durability, inorganic fine particles with specific surface area within these ranges may be combined.

Developer

The toner may be used as a one-component developer, but from the standpoint of obtaining stable image quality in the long term, it is preferably mixed with a magnetic carrier and used as a two-component developer in order to improve dot reproducibility. That is, this is preferably a two-component developer containing a toner and a magnetic carrier, in which the toner is the toner of the present invention.

A common, well-known magnetic carrier may be used, and examples include surface oxidized iron powders, unoxidized iron powders, metal particles of iron, lithium, calcium, magnesium, nickel, copper, zinc, cobalt, manganese, chromium, rare earths and the like, alloy particles and oxide particles of these, magnetic bodies such as ferrite, and resin carriers with dispersed magnetic bodies (so-called resin carriers) comprising binders resins carrying these magnetic bodies in a dispersed state.

When the toner is mixed with a magnetic carrier and used as a two-component developer, good effects can normally be obtained if the carrier mixing ratio (toner concentration of the two-component developer) is from 2 mass % to 15 mass %, or more preferably from 4 mass % to 13 mass %.

Method for Manufacturing Toner Particle

The method for manufacturing the toner particle is not particularly limited, and a conventional known method such as suspension polymerization, emulsion aggregation, melt kneading or dissolution suspension may be used.

The resulting toner particle may be used as is as the toner. An inorganic fine particle or other external additive as necessary may also be mixed with the resulting toner particle to obtain a toner. Mixing of the toner particle with the inorganic fine particle and other external additive can be accomplished using a mixing apparatus such as a double cone mixer, V mixer, drum mixer, Super mixer, Henschel mixer, Nauta mixer, Mechano Hybrid (Nippon Coke and Engineering), Nobilta (Hosokawa Micron) or the like.

The external additive is preferably used in the amount of from 0.1 to 10.0 mass parts per 100 mass parts of the toner particle.

In gel permeation chromatography measurement of the tetrahydrofuran-soluble component of the toner, the weight-average molecular weight is given as Mw(A), and the number-average molecular weight as Mn(A).

Mw(A) is preferably 25,000 to 0,000, or more preferably 32,000 to 48,000.

Mw(A)/Mn(A) is preferably 5 to 10, or more preferably 7 to 8.

Mn(A) is preferably 3,000 to 8,500, or more preferably 4,000 to 6,000.

Mw(A) can be controlled by controlling the monomer composition and molecular weight of the binder resin, and the manufacturing conditions.

Mw(A)/Mn(A) can be controlled by controlling the monomer composition and molecular weight of the binder resin, and the manufacturing conditions.

Within these ranges, low-temperature fixability and hot offset resistance are improved. The peak molecular weight in a molecular weight distribution curve obtained by GPC measurement of the THF-soluble component of the toner particle is preferably from 7,000 to 11,000, or more preferably from 8,200 to 10,500.

If the peak molecular weight is within this range, low-temperature fixability and hot offset resistance are improved.

When the molecular weight distribution curve has multiple peaks, the peak molecular weight in a molecular weight distribution curve obtained by GPC measurement of the THF-soluble component of the toner particle is the molecular weight of the highest peak.

The methods for measuring the various physical properties of the toner and raw materials are explained below.

Method for Measuring Volume Resistivity of Inorganic Fine Particle

The volume resistivity of the inorganic fine particle is measured as follows. A Keithley Instruments Model 6517 Electrometer/High Resistance System is used as the apparatus. Electrodes 25 mm in diameter are connected, inorganic fine particles are placed between the electrodes to a thickness of about 0.5 mm, and the distance between the electrodes is measured under about 2.0 N of load.

The resistance value is measured when 1,000 V of voltage has been applied to the inorganic fine particles for 1 minute, and volume resistivity is calculated according to the following formula.

$$\text{Volume resistivity } (\Omega\cdot\text{cm})=R\times L$$

R: Resistance value (Ω)

L: Distance between electrodes (cm)

Separation of Inorganic Fine Particles from Toner

The inorganic fine particles can also be separated from the toner by the following methods and measured.

200 g of sucrose (Kishida Chemical) is added to 100 mL of ion-exchanged water, and dissolved in a hot water bath to prepare a concentrated sucrose solution. 31 g of the concentrated sucrose solution and 6 mL of Contaminon N (a 10 mass % aqueous solution of a pH 7 neutral detergent for washing precision instruments, comprising a nonionic surfactant, an anionic surfactant and an organic builder, manufactured by Wako Pure Chemical Industries, Ltd.) are added to a centrifugation tube to prepare a dispersion solution. 1 g of the toner is added to this dispersion solution, and clumps of toner are broken up with a spatula or the like.

The centrifugation tube is shaken for 20 minutes in a shaker (KM Shaker (model: V.SX) IWAKI CO., LTD.) at a rate of 350 passes per minute. After being shaken, the solution is transferred to a glass tube (50 mL) for a swing rotor, and centrifuged under conditions of 3,500 rpm, 30 minutes in a centrifuge. Toner is present in the uppermost layer inside the glass tube after centrifugation, while inorganic fine particles are present in the aqueous solution of the lower layer. The aqueous solution of the lower layer is collected and centrifuged to separate the sucrose from the inorganic fine particles, and the inorganic fine particles are collected. Centrifugation is repeated as necessary, and once the separation is sufficient, the dispersion is dried, and the inorganic fine particles are collected.

When multiple inorganic fine particles have been added, they can be selected by centrifugation or the like.

Method for Measuring Dielectric Constants of Inorganic Fine Particle and Second Resin Using a 284A Precision LCR Meter (Hewlett Packard), the complex dielectric constant is measured at a frequency of 2 kHz after calibration at frequencies of 1 kHz and 1 MHz. 39200 kPa (400 kg/cm$^2$) of load is applied for 5 minutes to the sample to be measured, to mold a disc-shaped measurement sample 25 mm in diameter and not more than 1 mm thick (preferably 0.5 to 0.9 mm). This measurement sample is mounted on an ARES (Rheometric Scientific FE) equipped with a dielectric constant measurement jig (electrode) 25 mm in diameter, and measured at a frequency of 2 kHz under 0.49 N (50 g) of load in a 25° C. atmosphere.

Measuring Charge Decay Rate Coefficient of Toner

The charge decay rate coefficient of the toner was measured using an NS-D100 static diffusivity measurement device (Nano Seeds).

First, about 100 mg of toner is placed in a sample pan, and scraped to make the surface smooth. The sample pan is exposed for 30 seconds to X-rays with an X-ray static eliminator to remove the charge from the toner. The decharged sample pan is placed on a measurement plate. A metal plate is simultaneously mounted as a reference for zero correction of the surface voltometer. The measurement plate with the sample is left standing for 1 hour or longer in a 30° C., 80% RH environment prior to measurement.

The measurement conditions are set as follows.

Charge time: 0.1 sec

Measurement time: 1800 sec

Measurement interval: 1 sec

Discharge polarity:—

Electrodes: Yes

The initial potential is set at −600 V, and the change in surface potential beginning immediately after charging is measured. The results are fitted into the following formula to determine the charge decay rate coefficient α.

$$V_t=V_0\exp(-\alpha t^{1/2})$$

$V_t$: Surface potential (V) at time t $V_0$: Initial surface potential (V)

t: Time after charging (seconds)

α: Charge decay rate coefficient

Number-Average Particle Diameter of Primary Particles of Inorganic Fine Particle The number-average particle diameter of the primary particles of the inorganic fine particle is measured using an S-4800 Hitachi ultra-high resolution field emission scanning electron microscope (FE-SEM) (Hitachi High-Technologies).

Measurement is performed on the toner after the inorganic fine particle has been mixed in.

With the magnification set to 50,000, photographs are taken and further enlarged two times, the maximum diameter (major axis diameter) a and minimum diameter (minor axis diameter) b of the inorganic fine particles are measured from the resulting FE-SEM photographs, and (a+b)/2 is regarded as the particle diameter of these particles. The diameters of 100 randomly selected inorganic fine particles are measured, and the average is calculated and regarded as the number-average diameter of the primary particles of the inorganic fine particle.

Method for Measuring Content Ratio of Each Monomer Unit in First Resin

The content ratio of each monomer unit in the first resin is measured by $^1$H-NMR under the following conditions.

Measurement unit: FT NMR unit JNM-EX400 (JEOL Ltd.)

Measurement frequency: 400 MHz

Pulse condition: 5.0 μs

Frequency range: 10500 Hz

Number of integrations: 64

Measurement temperature: 30° C.

Sample: Prepared by placing 50 mg of the measurement sample in a sample tube with an inner diameter of 5 mm, adding deuterated chloroform ($CDCl_3$) as a solvent, and dissolving this in a thermostatic tank at 40° C.

Of the peaks attributable to constituent elements of the first monomer unit in the resulting $^1$H-NMR chart, a peak independent of peaks attributable to constituent elements of otherwise-derived monomer units is selected, and the integrated value $S_1$ of this peak is calculated.

Similarly, a peak independent of peaks attributable to constituent elements of otherwise-derived monomer units is selected from the peaks attributable to constituent elements of the second monomer unit, and the integrated value $S_2$ of this peak is calculated.

When the first resin contains a third monomer unit, a peak independent of peaks attributable to constituent elements of otherwise-derived monomer units is selected from the peaks attributable to constituent elements of the third monomer unit, and the integrated value $S_3$ of this peak is calculated.

The content of the first monomer unit is determined as follows using the integrated values $S_1$, $S_2$ and $S_3$. $n_1$, $n_2$ and $n_3$ are the numbers of hydrogen atoms in the constituent elements to which the observed peaks are attributed for each segment.

$$\text{Content (mol \%) of the first monomer unit}=\{(S_1/n_1)/((S_1/n_1)+(S_2/n_2)+(S_3/n_3))\}\times 100.$$

The second and third monomer units are determined similarly as shown below.

$$\text{Content (mol \%) of the second monomer unit}=\{(S_2/n_2)/((S_1/n_1)+(S_2/n_2)+(S_3/n_3))\}\times 100.$$

$$\text{Content (mol \%) of the third monomer unit}=\{(S_3/n_3)/((S_1/n_1)+(S_2/n_2)+(S_3/n_3))\}\times 100.$$

When a polymerizable monomer not containing a hydrogen atom in a constituent element other than a vinyl group is used in the first resin, measurement is performed in single pulse mode using $^{13}$C-NMR with $^{13}$C as the measurement nucleus, and the ratio is calculated in the same way as by $^{1}$H-NMR.

When the toner is manufactured by suspension polymerization, independent peaks may not be observed because the peaks of release agents and other resins overlap. It may thus be impossible to calculate the ratios of the monomer units derived from each of the polymerizable monomers in the first resin. In this case, a first resin can be manufactured and analyzed as the first resin by performing similar suspension polymerization without using a release agent or other resin.

Method for Calculating SP Value

SP Value such as $SP_{21}$ are determined as follows following the calculation methods proposed by Fedors.

The evaporation energy (Δei) (cal/mol) and molar volume (Δvi) ($cm^3$/mol) are determined from the tables described in "Polym. Eng. Sci., 14(2), 147-154 (1974)" for the atoms or atomic groups in the molecular structures of each of the polymerizable monomers, and $(4.184\times\Sigma\Delta ei/\Sigma\Delta vi)^{0.5}$ is regarded as the SP value $(J/cm^3)^{0.5}$.

$SP_{21}$ is calculated by similar methods for the atoms or atomic groups in the molecular structures of the same polymerizable monomers with the double bonds cleaved by polymerization.

Method for Measuring Melting Points

The melting points of such as the resin is measured under the following conditions using a DSC Q1000 (TA Instruments).

Ramp rate: 10° C./min

Measurement start temperature: 20° C.

Measurement end temperature: 180° C.

The melting points of indium and zinc are used for temperature correction of the device detection part, and the heat of fusion of indium is used for correction of the calorific value.

Specifically, 5 mg of sample is weighed precisely into an aluminum pan, and subjected to differential scanning calorimetry. An empty silver pan is used for reference.

The peak temperature of the maximum endothermic peak during the first temperature rise is regarded as the melting point.

When multiple peaks are present, the maximum endothermic peak is the peak at which the endothermic quantity is the greatest.

Methods for Measuring Peak Molecular Weight and Weight-Average Molecular Weight of THF-Soluble Component of Resin by GPC The peak molecular weight and weight-average molecular weight (Mw) of the THF-soluble component of a resin such as the first resin or second resin are measured as follows by gel permeation chromatography (GPC).

First, the sample is dissolved in tetrahydrofuran (THF) over the course of 24 hours at room temperature. The resulting solution is filtered through a solvent-resistant membrane filter (Maishori Disk, Tosoh Corp.) having a pore diameter of 0.2 Nm to obtain a sample solution. The concentration of THF-soluble components in the sample solution is adjusted to about 0.8 mass %. Measurement is performed under the following conditions using this sample solution.

System: HLC8120 GPC (detector: RI)(Tosoh Corp.)

Columns: Shodex KF-801, 802, 803, 804, 805, 806, 807 (total 7)(Showa Denko)

Eluent: Tetrahydrofuran (THF)

Flow rate: 1.0 mL/min

Oven temperature: 40.0° C.

Sample injection volume: 0.10 mL

A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Molecular Weight of THF-Soluble Component of Toner 0.5 mg of the toner to be measured is dissolved in 1 g of THF and ultrasound dispersed, the concentration is then adjusted to 0.5%, and the dissolved component is measured by GPC.

A HLC-8120GPC, SC-8020 (Tosoh) is used as the GPC unit, two TSK gel, Super HM-H columns (Tosoh, 6.0 mm ID×15 cm) as the columns, and THF as the eluent.

For the test conditions, the test is performed at a sample concentration of 0.5%, a flow rate of 0.6 mL/min, a sample injection volume of 10 μl and a measurement temperature of 40° C. using a refractive index (RI) detector.

A calibration curve is also prepared using Tosoh TSK standard polystylene A-500, F-1, F-10, F-80, F-380, A-2500, F-4, F-40, F-128 and F-700 (total 10 samples).

Method for Measuring Softening Point of Resin

The softening point of the resin is measured using a constant load extrusion type capillary rheometer (Shimadzu Corporation, CFT-500D Flowtester flow characteristics evaluation device) in accordance with the attached manual. With this device, the temperature of a measurement sample packed in a cylinder is raised to melt the sample while a fixed load is applied to the measurement sample from above with a piston, the melted measurement sample is extruded through a die at the bottom of the cylinder, and a flow curve can then be obtained showing the relationship between the temperature and the descent of the piston during this process.

In the present invention, the "melting temperature by ½ method" as described in the attached manual of the CFT-500D Flowtester flow characteristics evaluation device is given as the softening point.

The melting temperature by the ½ method is calculated as follows.

Half of the difference between the descent of the piston upon completion of outflow (outflow end point, given as "Smax") and the descent of piston at the beginning of outflow (minimum point, given as "Smin") is determined and given as X (X=(Smax−Smin)/2). The temperature in the flow curve at which the descent of the piston is the sum of X and Smin is the melting temperature by the ½ method.

For the measurement sample, about 1.0 g of resin is compression molded for about 60 seconds at about 10 MPa with a tablet molding compressor (such as MPa Systems Co., Ltd. NT-100H) in a 25° C. environment to obtain a cylindrical sample about 8 mm in diameter.

The specific operations for measurement are performed in accordance with the device manual.

The CFT-500D measurement conditions are as follows.

Test mode: Temperature increase method

Initial temperature: 50° C.

Achieved temperature: 200° C.

Measurement interval: 1.0° C.

Ramp rate: 4.0° C./min

Piston cross-sectional area: 1.000 $cm^2$

Test load (piston load): 10.0 kgf (0.9807 MPa)

Pre-heating time: 300 seconds

Die hole diameter: 1.0 mm

Die length: 1.0 mm

Measuring Glass Transition Temperature (Tg) of Resin

The glass transition temperature (Tg) is measured in accordance with ASTM D3418-82 using a differential scanning calorimeter (TA Instruments, Q2000).

The melting points of indium and zinc are used for temperature correction of the device detection part, and the fusion heat of indium is used to correct the calorimetric value.

Specifically, 3 mg of sample is weighed exactly, placed in an aluminum pan, and measured under the following conditions using an empty aluminum pan for reference.

Ramp rate: 10° C./min

Measurement start temperature: 30° C.

Measurement end temperature: 180° C.

During measurement, the temperature is first raised to 180° C. and maintained for 10 minutes, then lowered to 30° C. at a rate of 10° C./min, and then raised again. A specific heat change is obtained in the temperature range of 30° C. to 100° C. during this second temperature rise. The glass transition temperature (Tg) is the point of intersection between the differential thermal curve and a line intermediate between the baselines before and after the appearance of the specific heat change.

Method for Measuring Acid Value

The acid value is the number of mg of potassium hydroxide needed to neutralize the acid component contained in 1 g of sample. The acid value is measured as follows in accordance with JIS K 0070-1992.

(1) Reagent Preparation

A phenolphthalein solution is obtained by dissolving 1.0 g of phenolphthalein in 90 mL of ethyl alcohol (95 vol %) and adding ion-exchanged water to a total of 100 mL.

7 g of special-grade potassium hydroxide is dissolved in 5 mL of water, and this is brought to 1 L by addition of ethyl alcohol (95 vol %). This is placed in an alkali-resistant container while avoiding contact with carbon dioxide and the like, allowed to stand for 3 days, and filtered to obtain a potassium hydroxide solution. The resulting potassium hydroxide solution is stored in an alkali-resistant container. The factor of this potassium hydroxide solution is determined from the amount of the potassium hydroxide solution required for neutralization when 25 mL of 0.1 mol/L, hydrochloric acid is placed in an Erlenmeyer flask, several drops of the phenolphthalein solution are added, and titration is performed with the potassium hydroxide solution. The 0.1 mol/L hydrochloric acid is prepared in accordance with JIS K 8001-1998.

(2) Operations (A) Main Test 2.0 g of a pulverized sample is weighed exactly into a 200 mL Erlenmeyer flask, 100 mL of a toluene:ethanol (2:1) mixed solution is added, and the sample is dissolved over the course of 5 hours. Several drops of the phenolphthalein solution are then added as an indicator, and titration is performed using the potassium hydroxide solution. The titration endpoint is taken to be persistence of the faint pink color of the indicator for 30 seconds.

(B) Blank Test

Titration is performed by the same procedures, but without using any sample (that is, with only the toluene:ethanol (2:1) mixed solution).

(3) The Acid Value is Calculated by Substituting the Obtained Results into the Following Formula:

$$A=[(C-B)\times f\times 5.61]/S$$

where A is the acid value (mg KOH/g), B is the added amount (mL) of the potassium hydroxide solution in blank test, C is the added amount (mL) of the potassium hydroxide solution in main test, f is the factor of the potassium hydroxide solution, and S is the mass of the sample (g).

Method for Measuring Coverage Ratio of the Inorganic Fine Particle

To determine the coverage ratio of the inorganic fine particle, surface images of toner particles taken with an S-4800 Hitachi ultra-high resolution field emission scanning electron microscope (SEM, Hitachi High-Technologies) are analyzed with image analysis software (image-Pro Plus ver. 5.0, Nippon Roper).

Inorganic fine particles present on the surface of the toner particles are observed with this SEM apparatus.

During observation, locations where the toner particle surface is smooth are selected as much as possible.

Binarization is performed on an image in which only the inorganic fine particles are extracted on the toner particle surface, and the ratio of the area occupied by the inorganic fine particles relative to the area of the toner particle surface is calculated. The same operations are performed on 10 toner particles, and the arithmetic mean is calculated.

When the toner contains multiple external additives, a specific inorganic fine particle can be distinguished by the following method.

The inorganic fine particles are separated from the toner by the methods described above.

When multiple inorganic fine particles have been added, they are sorted by centrifugation.

The collected inorganic fine particles can be measured by FT-IR and NMR to sort out an inorganic fine particle with a compound having an alkyl group.

Weight-Average Particle Diameter (D4) of Toner Particle

Using a Multisizer (registered trademark) 3 Coulter Counter precise particle size distribution analyzer (Beckman Coulter, Inc.) based on the pore electrical resistance method and equipped with a 100 μm aperture tube, together with the accessory dedicated Beckman Coulter Multisizer 3 Version 3.51 software (Beckman Coulter, Inc.) for setting measurement conditions and analyzing measurement data, measurement is performed with 25000 effective measurement channels, and the measurement data are analyzed to calculate the weight-average particle diameter (14) of the toner particle (or toner).

The aqueous electrolyte solution used in measurement may be a solution of special grade sodium chloride dissolved in ion-exchanged water to a concentration of about 1 mass %, such as ISOTON II (Beckman Coulter, Inc.) for example.

The dedicated software settings are performed as follows prior to measurement and analysis.

On the "Standard measurement method (SOM) changes" screen of the dedicated software, the total count number in control mode is set to 50000 particles, the number of measurements to 1, and the Kd value to a value obtained with "standard particles 10.0 μm" (Beckman Coulter, Inc.). The threshold noise level is set automatically by pushing the "Threshold/Noise Level measurement button". The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to from 2 μm to 60 μm.

The specific measurement methods are as follows.

(1) About 200 mL of the aqueous electrolyte solution is added to a dedicated 250 mL round-bottomed beaker of the Multisizer 3, the beaker is set on the sample stand, and stirring is performed with a stirrer rod counter-clockwise at a rate of 24 rotations/second. Contamination and bubbles in the aperture tube are then removed by the "Aperture tube flush" function of the dedicated software.

(2) 30 mL of the same aqueous electrolyte solution is placed in a glass 100 mL flat-bottomed beaker, and about 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries) diluted 3× by mas with ion-exchanged water is added.

(3) A specific amount of ion-exchanged water is placed in the water tank of an ultrasonic disperser (Ultrasonic Dispersion System Tetora 150, Nikkaki Bios) with an electrical output of 120 W equipped with two built-in oscillators having an oscillating frequency of 50 kHz with their phases shifted by 180° from each other, and about 2 mL of the Contaminon N is added to this water tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolyte solution in the beaker.

(5) The aqueous electrolyte solution in the beaker of (4) is exposed to ultrasound as about 10 mg of toner is added bit by bit to the aqueous electrolyte solution, and dispersed. Ultrasound dispersion is then continued for a further 60 seconds. During ultrasound dispersion, the water temperature in the tank is adjusted appropriately to from 10° C. to 40° C.

(6) The aqueous electrolyte solution of (5) with the toner dispersed therein is dripped with a pipette into the round-bottomed beaker of (1) set on the sample stand, and adjusted to a measurement concentration of about 5%. Measurement is then performed until the number of measured particles reaches 50000.

(7) The measurement data is analyzed with the dedicated software attached to the apparatus, and the weight-average particle diameter (D4) is calculated. The weight-average particle diameter (D4) is the "Average diameter" on the "Analysis/volume statistical value (arithmetic mean)" screen when Graph/vol % is set in the dedicated software.

Methods for Observing Toner Cross-Section and Analyzing Matrix and Domains

Sections are first prepared as reference samples of abundance.

The first resin (crystalline resin) is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. A sample of the second resin (amorphous resin) is prepared in the same way.

The first resin and second resin are mixed at ratios of 0/100, 30/70, 70/30 and 0/100, and melt kneaded to prepare kneaded mixtures. These are similarly dispersed in visible light curable resin and cut to prepare sample sections.

Next, these reference samples are observed in cross-section by TEM-EDX using a transmission electron microscope (JEOL Ltd., JEM-2800 electron microscope), and element mapping is performed by EDX. The mapped elements are carbon, oxygen and nitrogen.

The mapping conditions are as follows.

Acceleration voltage: 200 kV
Electron beam exposure size: 1.5 nm
Live time limit: 600 sec
Dead time: 20 to 30
Mapping resolution: 256×256

(Oxygen element intensity/carbon element intensity) and (nitrogen element intensity/carbon element intensity) are calculated based on the spectral intensities of each element (average in 10 nm-square area), and calibration curves are prepared for the mass ratios of the first and second resin. When the monomer wits of the first resin contain nitrogen, the subsequent assay is performed using the (nitrogen element intensity/carbon element intensity) calibration curve.

The toner samples are then analyzed.

The toner is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. The cut sample is then observed by TEM-EDX using a transmission electron microscope (JEOL Ltd., JEM-2800 electron microscope). A cross-sectional image of the toner particle is obtained, and element mapping is performed by EDX. The mapped elements are carbon, oxygen and nitrogen.

Toner cross-sections for observation are selected as follows. The cross-sectional area of the toner is first determined from the cross-sectional image, and the diameter of a circle having the same area as the cross-sectional area (circle equivalent diameter) is determined. Observation is limited to toner cross-section images in which the absolute value of the difference between the circle equivalent diameter and the weight-average particle diameter (D4) is within 1.0 μm.

For the domains confirmed in the observed image, (oxygen element intensity/carbon element intensity) and/or (nitrogen element intensity/carbon element intensity) are calculated based on the spectrum intensities of each element (average of 10 nm square), and the ratios of the first and second resins are calculated based on a comparison with the calibration curves. A domain in which the ratio of the second resin is at least 80% is considered a domain in the present disclosure.

The domains confirmed in the observed image are specified and binarized to determine the particle diameter of the domains present in the toner cross-section. The particle diameter is given as the domain diameter. This is measured at 10 points in each toner, and the calculated average for the domains of 10 toners is given as the number-average diameter. Image Pro PLUS (Nippon Roper K. K.) is used for binarization.

Method for Separating Materials from Toner

Each of the materials contained in the toner can be separated from the toner using the differences among the materials in solubility in solvents.

First separation: The toner is dissolved in 23° C. methyl ethyl ketone (MEK), and the soluble component (second resin) is separated from the insoluble components (first resin, release agent, colorant, inorganic fine particle, etc.).

Second separation: The insoluble components obtained in the first separation (first resin, release agent, colorant, inorganic fine particle, etc.) are dissolved in 100° C. MEK, and the soluble components (first resin, release agent) are separated from the insoluble components (colorant, inorganic fine particle, etc.).

Third separation: The soluble components (first resin, release agent) obtained in the second separation are dissolved in 23° C. chloroform and separated into a soluble component (first resin) and an insoluble component (release agent).

When a Third Resin 6 included

First separation: The toner is dissolved in 23° C. methyl ethyl ketone (MEK), and the soluble components (second resin, third resin) are separated from the insoluble components (first resin, release agent, colorant, inorganic fine particle, etc.).

Second separation: The soluble components (second resin, third resin) obtained in the first separation are dissolved in 23° C. toluene and separated into a soluble component (third resin) and an insoluble component (second resin).

Third separation: The insoluble components (first resin, release agent, colorant, inorganic fine particle, etc.) obtained in the first separation are dissolved in 100° C. MEK and separated into soluble components (first resin, release agent) and insoluble components (colorant, inorganic fine particle, etc.).

Fourth separation: The soluble components (first resin, release agent) obtained in the third separation are dissolved in 23° C. chloroform and separated into a soluble component (first resin) and an insoluble component (release agent).

Measuring Contents of First Resin and Second Resin in Binder Resin in Toner

The masses of the soluble components and insoluble components obtained in the separation steps above are measured to calculate the contents of the first resin and second resin in the binder resin in the toner.

EXAMPLES

The present invention is explained using the examples below. However, these do not in any way limit the present invention. Unless otherwise specified, parts in the formulations below are based on mass.

Manufacturing Example of Inorganic Fine Particle 1

Metatitanic acid obtained by the sulfuric acid method was subjected to deferrous bleaching, sodium hydroxide aqueous solution was added to bring the pH to 9.0, and desulfurization was performed, after which the pH was neutralized to 5.8 with hydrochloric acid, and the product was filtered and washed. Water was added to the washed cake to obtain a slurry containing 1.5 mol/L of $TiO_2$, and hydrochloric acid was added to adjust the pH to 1.5 for peptization.

The desulfurized and peptidized metatitanic acid was collected as $TiO_2$, and placed in a 3 L reaction vessel. A strontium chloride aqueous solution was added to the peptidized metatitanic acid slurry to obtain an $SrO/TiO_2$ molar ratio of 1.15, ater which the $TiO_2$ concentration was adjusted to 0.8 mol/L. This was then heated to 90° C. under stirring and mixing, and nitrogen gas microbubbling was performed at 600 mL/min as 444 mL of a 10 mol/L sodium hydroxide aqueous solution were added over the course of 45 minutes, after which nitrogen gas microbubbling was performed at 400 mL/min as the slurry was stirred for 1 hour at 95° C.

The reaction slurry was then stirred and cooled to 15° C. as 10° C. cooling water was passed through the jacket of the reaction vessel, hydrochloric acid was added until the pH was 2.0, and stirring was continued for 1 hour. The resulting precipitate was decantation washed, 5.0 mass % of sodium stearate relative to the solids component was dissolved in water and added in the form of an aqueous solution, and stirring was maintained continuously for 2 hours, after which the pH was adjusted to 6.5 with hydrochloric acid, and stirring was maintained continuously for 1 hour to precipitate stearic acid on the surface of the strontium titanate.

This was then filtered and washed, and the resulting cake was left for 10 hours in atmosphere at 120° C., and crushed in a jet mill until no aggregations remained to obtain an inorganic fine particle 1. In measurement of the inorganic fine particle 1 by powder X-ray diffraction, the diffraction peak of strontium titanate was observed. The physical properties are shown in Table 1.

Manufacturing Example of Inorganic Fine Particle 2

A water-containing titanium oxide slurry obtained by hydrolyzing a titanium sulfate aqueous solution was washed with an aqueous alkali solution. Next, hydrochloric acid was added to the water-containing titanium oxide slurry to adjust the pH to 0.65 and obtain a titania sol dispersion. NaOH was added to this titania sol dispersion to adjust the pH of the dispersion to 4.5, and washing was repeated until the electrical conductivity of the supernatant was 70 μS/cm.

0.97 times the molar amount of $Sr(OH)_2.8H_2O$ was added to this water-containing titanium oxide, which was then placed in a SUS reaction vessel, and nitrogen gas was substituted. Distilled water was then added to obtain a concentration of 0.1 to 2.0 mol/liter (as $SrTiO_3$).

This dispersion was sprayed together with oxygen gas and propane gas through a fine particle spray nozzle into an 80-liter combustion reaction tank and combusted, and then collected through a filer to obtain a fine particle. Pure water was added to the resulting fine particle, 6 mol/liter of hydrochloric acid was added to the resulting slurry to adjust the pH to 2.0, 3.6 parts of calcium stearate were added per 100 parts of solids, and the mixture was stirred for 18 hours. This was then neutralized with a 4 mol/liter sodium hydroxide aqueous solution, stirred for 2 hours and then separated by filtration, and then dried for 8 hours in a 120° C. atmosphere to obtain an inorganic fine particle 2.

In powder X-ray analysis, the inorganic fine particle 2 exhibited a strontium titanate diffraction peak. The physical properties are shown in Table 1.

Manufacturing Example of Inorganic Fine Particle 3

An inorganic fine particle 3 was obtained as in the manufacturing example of the inorganic fine particle 1 except that calcium chloride was substituted for the strontium chloride, and nitrogen gas microbubbling was not performed. The physical properties are shown in Table 1.

Manufacturing Example of Inorganic Fine Particle 4

200 parts of zinc oxide were added to an aqueous hydrochloric acid solution consisting of 500 parts of 35 mass % hydrochloric acid and 700 parts of purified water, and the zinc oxide was completely dissolved to prepare a zinc chloride aqueous solution. Meanwhile, 460 parts of ammonium carbonate were dissolved in 3000 parts of purified water to separately prepare an aqueous solution of ammonium bicarbonate. The zinc chloride aqueous solution was added to the ammonium bicarbonate aqueous solution over the course of 60 minutes to produce a sediment. The sediment was thoroughly washed, separated from the liquid phase, and dried for 5 hours at 130° C.

Next, the dried powder was crushed in an agate mortar. The crushed powder was heated to 500° C. at a rate of 200° C./hour as a mixed gas of 0.21 L/minute of nitrogen gas and 0.09 L/minute of hydrogen gas was supplied. This was maintained as is for 2 hours and then cooled to room temperature, after which sodium stearate in the amount of 5.0 mass % of the resulting zinc oxide fine particle was dissolved in water and added in the form of an aqueous solution, continuous stirring was maintained for 2 hours, hydrochloric acid was added to adjust the pH to 6.5, and continuous stirring was maintained for 1 hour to precipitate stearic acid on the surface of the zinc oxide fine particle.

This was then filtered and washed to obtain a cake that was next dried for 10 hours in atmosphere at 120° C., and crushed in a jet mill until no aggregations remained to obtain an inorganic fine particle 4. The physical properties are shown in Table 1.

Manufacturing Example of Inorganic Fine Particle 5

A hydrated titanium oxide slurry obtained by thermal hydrolysis of a titanyl sulfate aqueous solution was neutralized to pH 7 with ammonia water, and filtered and washed to obtain a cake, and the titanium oxide of the cake was peptized with hydrochloric acid to obtain an anatase-type titania sol. The average primary particle diameter of this sol was 7 nm.

Using ilmenite ore containing 50 mass % of $TiO_2$ equivalent as a starting material, this starting material was dried for 2 hours at 150° C., and dissolved by addition of sulfuric acid to obtain a $TiOSO_4$ aqueous solution. This was concentrated, 4.0 parts of the above anatase titania sol as $TiO_2$ equivalent were added as a seed to 100 parts of $TiO_2$ equivalents, and hydrolysis was performed at 120° C. to obtain a slurry of TiO(OH) containing impurities.

This slurry was repeatedly water washed at pH 5 to 6 to thoroughly remove the sulfuric acid, $FeSO_4$ and impurities. A slurry of high-purity metatitanic acid [$TiO(OH)_2$] was then obtained.

This metatitanic acid was heat treated for 6 hours at 270° C., then thoroughly crushed to obtain an anatase crystal titanium oxide fine particle with a BET specific surface area of 50 $m^2/g$ and a number-average particle diameter of 50 nm.

Next, sodium stearate in the amount of 5.0 mass % of the anatase titanium oxide fine particle was added in the form of an aqueous solution dissolved in water, continuous stirring was maintained for 2 hours, hydrochloric acid was added to adjust the pH to 6.5, and continuous stirring was maintained for 1 hour to precipitate stearic acid on the surface of the titanium oxide fine particle.

This was then filtered and washed, and the resulting cake was dried in atmosphere for 10 hours at 120'C and crushed in a jet mill until no aggregations remained to obtain an inorganic fine particle 5. The physical properties are shown in Table 1.

Manufacturing Example of Inorganic Fine Particle 6

The following operations were performed after the anatase titanium oxide fine particle was obtained in the manufacturing example of the inorganic fine particle 5. Hydrochloric acid was added to a dispersion of the anatase titanium oxide fine particle to adjust the pH to 6.5, 0.5 parts of octyl-modified silicone oil (FZ-3196, Dow Corning Corp.) were added per 100 parts of the anatase titanium oxide fine particle, and the mixture was maintained under stirring for 1 hour.

This was then filtered and washed to obtain a cake that was then dried for 10 hours in a 120° C. atmosphere and crushed in a jet mill to eliminate agglomerations of titanium particles and obtain an inorganic fine particle 6. The physical properties are shown in Table 1.

Manufacturing Example of Inorganic Fine Particle 7

The following operations were performed after the anatase titanium oxide fine particle was obtained in the manufacturing example of the inorganic fine particle 5. A dispersion of the anatase titanium oxide fine particle was adjusted to 50° C., and hydrochloric acid was added to adjust the pH to 2.5, after which 5 parts of stearyl trimethoxysilane were added per 100 parts of the solids and the mixture was maintained under stirring for 6 hours.

The pH was then adjusted to 6.5 with sodium hydroxide aqueous solution, stirring was continued for 1 hour, and the mixture was filtered to obtain a cake that was dried for 10 hours in a 120° C. atmosphere. This was crushed in a jet mill until agglomerations of titanium oxide fine particles were eliminated to obtain an inorganic fine particle 7. The physical properties are shown in Table 1.

Manufacturing Example of Inorganic Fine Particle 8

An inorganic fine particle 8 was obtained as in the manufacturing example of the inorganic fine particle 7 except that isobutyl trimethoxysilane was used instead of stearyl trimethoxysilane. The physical properties are shown in Table 1.

Manufacturing Example of Inorganic Fine Particle 9

The following operations were performed after the anatase titanium oxide fine particle was obtained in the manufacturing example of the inorganic fine particle 5. The anatase titanium oxide fine particle was placed in an autoclave together with a 2080 vol % 1-tetracosanol/n-hexane mixed solution. This was heated for 1 hour at 240° C. under 2.8 MPa of pressure. This was then filtered and washed to obtain a cake that was dried for 10 hours in a 120° C. atmosphere. This was crushed in a jet mill until agglomerations of titanium oxide fine particles were eliminated to obtain an inorganic fine particle 9. The physical properties are shown in Table 1.

Manufacturing Example of Inorganic Fine Particle 10

An inorganic fine particle 10 was obtained as in the manufacturing example of the inorganic fine particle 9 except that n-octacosanol was used instead of 1-tetracosanol. The physical properties are shown in Table 1.

Manufacturing Example of Inorganic Fine Particle 11

An inorganic fine particle 11 was obtained as in the manufacturing example of the inorganic fine particle 9 except that n-propanol was used instead of 1-tetracosanol. The physical properties are shown in Table 1.

Manufacturing Example of Inorganic Fine Particle 12

Manufacturing was performed by the following methods using the zinc oxide fine particle before addition of the 5.0 mass % sodium stearate aqueous solution in the manufacturing example of the inorganic fine particle 4.

The zinc oxide fine particle was placed in an autoclave together with a 20/80 vol % n-propanol/n-hexane mixed solution. This was heated for 1 hour at 240° C. under 2.8 MPa of pressure. This was then filtered and washed to obtain a cake that was dried for 10 hours in a 120° C. atmosphere. This was then crushed in a jet mill until agglomerations of zinc oxide fine particles were eliminated to obtain an inorganic fine particle 12.

The atmosphere, temperature, length of the flame and the like were adjusted by controlling the amount and flow rate of the combustion gas and oxygen. A silica fine particle was formed in the flame from the silicon compound, and fused until the desired particle diameter was obtained. This was then cooled, and collected in a bag filter to obtain a silica fine particle.

TABLE 1

| Inorganic fine particle No. | Composition | Surface treatment | Alkyl group carbon No. | Number-average primary particle diameter nm | Volume resistivity Ω · cm | Dielectric constant pF/m |
|---|---|---|---|---|---|---|
| 1 | Strontium titanate | Stearic acid | C18 | 30 | 1.0E+10 | 35 |
| 2 | Strontium titanate | Calcium stearate | C18 | 80 | 1.8E+10 | 50 |
| 3 | Calcium titanate | Stearic acid | C18 | 60 | 8.0E+08 | 90 |
| 4 | Zinc oxide | Stearic acid | C18 | 25 | 2.0E+08 | 21 |
| 5 | Titanium oxide | Stearic acid | C18 | 35 | 1.0E+11 | 26 |
| 6 | Titanium oxide | Octyl-modified silicone oil | C8 | 35 | 3.0E+12 | 26 |
| 7 | Titanium oxide | Stearyl trimethoxysilane | C18 | 35 | 6.0E+12 | 24 |
| 8 | Titanium oxide | Isobutyl trimethoxysilane | C4 | 35 | 3.0E+12 | 24 |
| 9 | Titanium oxide | 1-tetracosanol | C24 | 35 | 9.0E+11 | 25 |
| 10 | Titanium oxide | 1-octocosanol | C28 | 35 | 9.0E+11 | 26 |
| 11 | Titanium oxide | n-propanol | C3 | 35 | 1.0E+12 | 24 |
| 12 | Zinc oxide | n-propanol | C3 | 35 | 2.0E+05 | 20 |
| 13 | Titanium oxide | n-propanol | C3 | 35 | 8.0E+12 | 45 |
| 14 | Titanium oxide | None | None | 35 | 1.0E+12 | 60 |
| 15 | Antimony-doped tin oxide | n-propanol | C3 | 25 | 1.0E+01 | — |
| 16 | Silica | n-propanol | C3 | 45 | 1.0E+14 | 15 |

In the table, "1.0E+10" means "$1.0 \times 10^{10}$".

Manufacturing Example of Inorganic Fine Particle 13

An inorganic fine particle 13 was obtained as in the manufacturing example of the inorganic fine particle 11 except that the ratio of the mixed solution of n-propanol/n-hexane was changed to 5.95. The physical properties are shown in Table 1.

Manufacturing Example of Inorganic Fine Particle 14

An inorganic fine particle 14 was obtained as in the manufacturing example of the inorganic fine particle 5 except that treatment with a sodium stearate aqueous solution was not performed. The physical properties are shown in Table 1.

Manufacturing Example of Inorganic Fine Particle 15

An inorganic fine particle 15 was obtained as in the manufacturing example of the inorganic fine particle 11 except that an antimony-doped tin oxide fine particle (SN-100P, Ishihara Sangyo Kaisha, Ltd.) was used instead of the anatase titanium oxide fine particle. The physical properties are shown in Table 1.

Manufacturing Example of Inorganic Fine Particle 16

An inorganic fine particle 16 was obtained as in the manufacturing example of the inorganic fine particle 11 except that a silica fine particle manufactured by the following method was used instead of the anatase titanium oxide fine particle. The physical properties are shown in Table 1.

A double-pipe hydrocarbon-oxygen mixed burner capable of forming an inner flame and an outer flame was used as a combustion furnace. A two-fluid nozzle for slurry injection was installed at the center of the burner, and a raw material silicon compound was introduced. A hydrocarbon-oxygen combustion gas was sprayed from around the two-fluid nozzle, to form an outer flame and an inner flame as a reducing atmosphere.

Manufacturing Example of Crystalline Resin C1

Solvent: Toluene 100.0 parts

Monomer composition: 100.0 parts (Monomer composition is a mixture of the following behenyl acrylate, methacrylonitrile, styrene and acrylic acid in the following proportions)

(Behenyl acrylate (1st polymerizable monomer): 67.0 parts (28.9 mol %))

(Methacrylonitrile (2nd polymerizable monomer): 21.5 parts (52.7 mol %))

(Styrene (3rd polymerizable monomer): 11.0 parts (17.3 mol %))

(Acrylic acid: 0.5 parts (1.1 mol %))

Polymerization initiator: t-butyl peroxypivalate (NOF Corp. Perbutyl PV) 0.5 parts These materials were placed in a nitrogen atmosphere in a reaction vessel equipped with a reflux condenser, a stirrer, a thermometer and a nitrogen introduction pipe. The inside of the reaction vessel was stirred at 200 rpm as the mixture was heated to 70° C. and a polymerization reaction was performed for 12 hours, to obtain a solution of a polymer of the monomer composition dissolved in toluene. Next, the solution was cooled to 25° C. and then added under stirring to 1000.0 parts of methanol, and a methanol-insoluble component was precipitated. The resulting methanol-insoluble component was filtered out, washed with methanol, and vacuum dried for 24 hours at 40° C. to obtain a crystalline resin C1. The crystalline resin C1 had a weight-average molecular weight of 68400, a melting point of 62° C. and an acid value of 10 mg KOH/g.

In NMR analysis, the crystalline resin C1 contained 28.9 mol % of a monomer unit derived from behenyl acrylate, 53.8 mol % of a monomer unit derived from methacrylonitrile and 17.3 mol % of a monomer unit derived from styrene. The content ratio of the first monomer unit was 67.0 mass %.

The SP value of the monomer unit derived from the second polymerizable monomer was 29.13 $(J/cm^3)^{0.5}$.

Manufacturing Example of Crystalline Resin C2

470 parts of toluene were placed in an autoclave, nitrogen was substituted, and the temperature was raised to 105° C. in a scaled state under stirring. A mixture of 500 parts of behenyl acrylate (C22), 250 parts of styrene, 250 parts of acrylonitrile, 20 parts of methacrylic acid, 5 parts of alkylallyl sulfosuccinic sodium salt, 19 parts of 2-isocyanatoethyl methacrylate, 3.7 parts oft-butylperoxy-2-ethylhexanoate and 240 parts of toluene was dripped in and polymerized over the course of 2 hours with the internal temperature of the autoclave controlled at 105° C.

The same temperature was maintained for a further 4 hours to complete the reaction, after which 16 parts of di-normal butylamine and 5 parts of bismuth catalyst (Nitto Kasci Co., Ltd., Neostann U-600) were added, and the mixture was reacted for 6 hours at 90° C. The solvent was then removed at 100° C. to obtain a crystalline resin C2. The crystalline resin C2 had a weight-average molecular weight of 100000, a melting point of 46° C. and an acid value of 10 mg KOH/g. The content ratio of the first monomer unit was 49.0 mass %.

The SP value of the monomer unit derived from acrylonitrile was 22.75 $(3/cm^3)^{0.5}$.

Manufacturing Example of Crystalline Resin C3

138 parts of xylene were placed in an autoclave, nitrogen was substituted, and the temperature was raised to 170° C. in a sealed state under stirring. A mixed solution of 200 parts of behenyl acrylate (C22), 150 parts of styrene, 300 parts of acrylonitrile, 600 parts of vinyl acetate, 1.5 parts of di-t-butyl peroxide and 100 parts of xylene was dripped in and polymerized over the course of 3 hours with the internal temperature of the autoclave controlled at 170° C.

After dripping, the drip line was washed with 12 parts of xylene. This was then maintained at the same temperature for 4 hours to complete polymerization. The solvent was removed for 3 hours at 100° C. under reduced pressure of 0.5 to 2.5 kPa to obtain a crystalline resin C3.

The crystalline resin C3 had a weight-average molecular weight of 45000, a melting point of 60° C., and an acid value of 10 mg KOH/g. The content ratio of the first monomer unit was 23.5 mass %.

The SP value of the monomer unit derived from vinyl acetate was 18.31 $(J/cm^3)^{0.5}$.

Manufacturing Example of Crystalline Resin C4

Dodecanediol: 34.5 parts (0.29 moles; 100.0 mol % relative to total moles of polyhydric alcohol)

Sebacic acid: 65.5 parts (0.28 moles; 100.0 mol % relative to total moles of polyvalent carboxylic acid)

These materials were weighed into a reaction tank equipped with a cooling pipe, a stirrer, a nitrogen introduction pipe and a thermocouple. The flask was then purged with nitrogen gas, the temperature was gradually raised under stirring, and the mixture was stirred at 140° C. while beings reacted for 3 hours.

Tin 2-ethylhexanoate: 0.5 parts

This material was then added, the pressure inside the reaction vessel was lowered to 8.3 kPa, and the mixture was reacted for 4 hours with the temperature maintained at 200° C., after which the reaction vessel was gradually opened to return the pressure to normal pressure and obtain a crystalline resin C4. The crystalline resin C4 had a weight-average molecular weight of 30000, a melting point of 50° C., and an acid value of 10 mg KOH/g. The content ratio of the first monomer unit was 0 mass %.

Manufacturing Example of Crystalline Resin C5

138 parts of xylene were placed in an autoclave, which was then purged with nitrogen, after which the temperature was raised to 170° C. under stirring in a sealed state. A mixed solution of 450 parts of behenyl acrylate (C22), 150 parts of styrene, 150 parts of acrylonitrile, 1.5 parts of di-t-butyl peroxide and 100 pars of xylene was dripped in and polymerized over the course of 3 hours with the internal temperature of the autoclave controlled at 170° C.

After dripping, the drip line was washed with 12 parts of xylene. This was then maintained at the same temperature for 4 hours to complete polymerization. The solvent was removed for 3 hours at 100° C. under reduced pressure of 0.5 to 2.5 kPa to obtain a crystalline resin C5.

The crystalline resin C5 had a weight-average molecular weight of 14000, a melting point of 60° C., and an acid value of 0 mg KOH/g. The content ratio of the first monomer unit was 60.0 mass %.

The SP value of the monomer unit derived from acrylonitrile was 22.75 $(J/cm^3)^{0.5}$.

Manufacturing Example of Crystalline Resin C6

A crystalline resin C6 was obtained as in the manufacturing example of the crystalline resin C3 except that the amount of behenyl acrylate (C22) was changed to 500 parts.

The crystalline resin C6 had a weight-average molecular weight of 46000, a melting point of 55° C., and an acid value of 8 mg KOH/g. The content ratio of the first monomer unit was 32.3 mass %.

Manufacturing Example of Crystalline Resin C7

A crystalline resin C7 was obtained as in the manufacturing example of the crystalline resin C3 except that the 200 parts of behenyl acrylate (C22) were changed to 500 parts of stearyl acrylate (C18).

The crystalline resin C7 had a weight-average molecular weight of 38000, a melting point of 50° C., and an acid value of 3 mg KOH/g. The content ratio of the first monomer unit was 32.3 mass %.

Manufacturing Example of Crystalline Resin C8

A crystalline resin C8 was obtained as in the manufacturing example of the crystalline resin C3 except that the amount of behenyl acrylate (C22) was changed to 700 parts.

The crystalline resin C8 had a weight-average molecular weight of 28000, a melting point of 65° C. and an acid value of 30 mg KOH/g. The content ratio of the first monomer unit was 40.0 mass %.

Manufacturing Example of Amorphous Resin A1

Polyoxypropylene (2.2)-2,2-bis(4-hydroxyphenyl) propane: 73.4 parts (0.186 moles; 100.0 mol % relative to total moles of polyhydric alcohol)

Terephthalic acid: 11.6 parts (0.070 moles; 45.0 mol % relative to total moles of polyvalent carboxylic acids)

Adipic acid: 6.8 parts (0.047 moles; 30.0 mol % relative to total moles of polyvalent carboxylic acids)

Tin di(2-ethylhexanate): 0.5 parts

These materials were weighed into a reaction tank equipped with a cooling pipe, a stirrer, a nitrogen introduction pipe and a thermocouple. The interior of the flask was purged with nitrogen gas, the temperature was raised gradually under stirring, and the mixture was stirred at 200° C. while being reacted for 2 hours.

The pressure inside the reaction tank was then lowered to 8.3 kPa and maintained for 1 hour, after which the temperature was lowered to 180° C. and the pressure was returned to atmospheric pressure (first reaction step).

Trimellitic anhydride: 8.2 parts (0.039 moles; 25.0 mol % relative to total moles of polyvalent carboxylic acids)

Tert-butyl catechol (polymerization inhibitor): 0.1 part

The above materials were then added, the pressure inside the reaction tank was lowered to 8.3 kPa, and the temperature was maintained at 160° C. as the mixture was reacted for 15 hours. The temperature was lowered to stop the reaction (second reaction step) and obtain an amorphous resin A1. The resulting amorphous resin A1 had a peak molecular weight Mp of 11000, a glass transition temperature Tg of 58° C. and an acid value of 20 mg KOH/g.

Manufacturing Examples of Amorphous Resins A2 and A4 to A9

Amorphous resins A2 and A4 to A9 were obtained by performing the same reactions as in the manufacturing example of the amorphous resin A1 except that the alcohol component or carboxylic acid component and the molar ratios were changed as shown in Table 1. The mass parts of the raw materials were adjusted so that the total moles of the alcohol component and carboxylic acid component were the same as in the manufacturing example of the amorphous resin A1. The physical properties of the resulting amorphous resins are shown in Tables 2-1 and 2-2.

Manufacturing Example of Amorphous Resin A3

Polyoxypropylene (2.2)-2,2-bis(4-hydroxyphenyl) propane: 75.4 parts (0.192 moles; 100.0 mol % relative to total moles of alcohol component)

Terephthalic acid: 17.8 parts (0.111 moles; 70.0 mol % relative to total moles of carboxylic acid components)

Succinic acid: 3.4 parts (0.024 moles; 15.0 mol % relative to total moles of carboxylic acid components)

Oxalic acid: 3.4 parts (0.024 moles; 15.0 mol % relative to total moles of carboxylic acid components)

Tin di(2-ethylhexylate): 1.0 part per 100 parts of total monomer components

These materials were weighed into a reaction tank equipped with a cooling pipe, a stirrer, a nitrogen introduction pipe and a thermocouple. The interior of the flask was purged with nitrogen gas, the temperature was raised gradually under stirring, and the mixture was stirred at 200° C. while being reacted for 5 hours to obtain an amorphous resin A3.

The resulting amorphous resin A3 had a peak molecular weight of 4700 by GPC. The glass transition temperature was 56° C., and the acid value was 7 mg KOH/g.

Manufacturing Examples of Amorphous Resins A10 and A11

Amorphous resins A10 and A11 were obtained by performing the same reactions as in the manufacturing example of the amorphous resin A3 except that the alcohol component or carboxylic acid component and the molar ratios were changed as shown in Table 1. The mass parts of the raw materials were adjusted so that the total moles of the alcohol component and carboxylic acid component were the same as in the manufacturing example of the amorphous resin A3. The physical properties are shown in Tables 2-1 and 2-2.

Manufacturing Example of Amorphous Resin A12

50 parts of a bisphenol A propylene oxide 2-mol adduct, 50 parts of a bisphenol A ethylene oxide 2-mol adduct, 10 parts of fumaric acid, 65 parts of terephthalic acid, 10 parts of acrylic acid and 15 parts of tin (1) dioctanoate were placed in a 4-necked flask equipped with a thermometer, a stirrer, and condenser and a nitrogen introduction pipe, and polymerized for 4.5 hours at 230° C. in a nitrogen atmosphere.

Once this had cooled to 160° C., 25 parts of trimellitic acid were added.

Next, a mixture of 450 parts of styrene, 200 parts of 2-ethylhexyl acrylate and 30 parts of dicumyl peroxide as a polymerization initiator was dripped in over the course of 2 hours at 160° C. After completion of dripping, the temperature was raised to 200° C. and the mixture was reacted for 3 hours to obtain an amorphous resin A12 with a softening point of 115° C.

The resulting amorphous resin A12 had a peak molecular weight of 9000 by GPC. The glass transition temperature was 60° C., and the acid value was 5 mg KOH/g.

Manufacturing Example of Amorphous Resin A13

Low-molecular-weight polypropylene (Sanyo Chemical Industries, Ltd., Viscol 660P): 10.0 parts (0.02 moles; 2.4 mol % relative to total moles of constituent monomers)

Xylene: 25.0 parts

These materials were weighed into a reaction tank equipped with a cooling pipe, a stirrer, a nitrogen introduction pipe and a thermocouple. The flask was purged with nitrogen gas, and the temperature was gradually raised to 175° C. under stirring.

Styrene: 68.0 parts (0.65 moles; 76.4 mol % relative to total moles of constituent monomers)

Cyclohexyl methacrylate: 5.0 parts (0.03 moles; 3.5 mol % relative to total moles of constituent monomers)

Butyl acrylate: 12.0 parts (0.09 moles: 11.0 mol % relative to total moles of constituent monomers)

Methacrylic acid: 5.0 parts (0.06 moles, 6.7 mol % relative to total moles of constituent monomers)

Xylene: 10.0 parts

Di-t-butyl peroxyhexahydro teraphthalate: 0.5 parts

These materials were then dripped in over the course of 2.5 hours, and the mixture was stirred for a further 40 minutes. The solvent was then distilled off to obtain an amorphous resin A13 comprising a styrene acrylic polymer grafted to a polyolefin.

The resulting amorphous resin A13 had a peak molecular weight of 11000 by GPC. The glass transition temperature was 62° C., and the acid value was 0.4 mg KOH/g.

TABLE 2-1

| Amorphous resin) (polyester | Alcohol | | | Acid | | | | | | | |
|---|---|---|---|---|---|---|---|---|---|---|---|
| resin) No. | BPA-PO (2.2) | BPA-EO (2.2) | EG | TFA | TMA | FA C2 | OA C2 | SUA C4 | AA C6 | SEA C10 | DCA C16 |
| A1 | 100 mol % | | | 45 mol % | 25 mol % | | | | 30 mol % | | |
| A2 | 60 mol % | 40 mol % | | 45 mol % | 25 mol % | | | | 30 mol % | | |
| A3 | 100 mol % | | | 70 mol % | | | 15 mol % | 15 mol % | | | |
| A4 | 100 mol % | | | 30 mol % | 15 mol % | 25 mol % | | | 30 mol % | | |
| A5 | 100 mol % | | | 65 mol % | 25 mol % | | | | 10 mol % | | |

TABLE 2-1-continued

| Amorphous resin) (polyester resin) No. | Alcohol BPA-PO (2.2) | BPA-EO (2.2) | EG | Acid TFA | TMA | FA C2 | OA C2 | SUA C4 | AA C6 | SEA C10 | DCA C16 |
|---|---|---|---|---|---|---|---|---|---|---|---|
| A6 | 100 mol % | | | 6 mol % | 60 mol % | | | | 12 mol % | | 22 mol % |
| A7 | 100 mol % | | 30 mol % | 6 mol % | 60 mol % | | | | | | 34 mol % |
| A8 | 70 mol % | | | 45 mol % | 25 mol % | | | | 30 mol % | | |
| A9 | 100 mol % | | | 15 mol % | 25 mol % | | | | 60 mol % | | |
| A10 | 100 mol % | | | 85 mol % | | | | 15 mol % | | | |
| A11 | 100 mol % | | | 75 mol % | | | | 15 mol % | | 10 mol % | |

The abbreviations in the Table 2-1 are defined as follows.
BPA-PO (2.2): Bisphenol A propylene oxide 2.2-mol adduct
BPA-EO (2.2): Bisphenol A ethylene oxide 2.2-mol adduct
EG: ethylene glycol
TFA: Terephthalic acid
TMA: Trimellitic acid
FA: Fumaric acid
OA: Oxalic acid
SUA: Succinic acid
AA: Adipic acid
SEA: Sebacic acid
DCA: Dodecenylsuccinic acid anhydride

TABLE 2-2

| Amorphous (polyester resin) No. resin | Physical properties Mp | Tg | Acid value | Dielectric constant |
|---|---|---|---|---|
| A1 | 11000 | 58 | 20 | 2.5 |
| A2 | 10000 | 60 | 24 | 2.5 |
| A3 | 4700 | 56 | 7 | 2.5 |
| A4 | 11000 | 58 | 20 | 2.5 |
| A5 | 9000 | 62 | 15 | 2.5 |
| A6 | 20000 | 62 | 22 | 2.5 |
| A7 | 20000 | 62 | 20 | 25 |
| A8 | 9000 | 57 | 36 | 2.5 |
| A9 | 15000 | 54 | 45 | 2.5 |
| A10 | 4600 | 55 | 7 | 2.5 |
| A11 | 6200 | 54 | 5 | 2.5 |

The Tg is given in units of ° C. and the acid value in units of mg KOH/g, and the dielectric constant is the dielectric constant pF/m at 2 kHz.

Manufacturing Example of Binder Resin 1

32 parts of the amorphous resin A6 were mixed with 68 parts of the crystalline resin C1, and supplied at a rate of 52 kg/hour to a twin-screw kneader (Kurimoto, Ltd., S5KRC kneader) while at the same time 1.0 part oft-butyl peroxy-isopropyl monocarbonate as a radical reaction initiator (c) was supplied at a rate of 0.52 kg (hour and the two were kneaded and extruded for 7 minutes at 160° C., 90 rpm to perform a crosslinking reaction, and then mixed as the pressure was lowered to 10 kPa from the vent mouth to remove the organic solvent. The mixed product was cooled to obtain a binder resin 1.

Manufacturing Examples of Binder Resins 2 to 21

Binder resins 2 to 21 were obtained as in the manufacturing example of the binder resin 1 except that the types and mixing ratios of the amorphous resin and crystalline resin were changed as shown in Table 3.

TABLE 3

| Binder resin No. | Binder resin ① Crystalline resin | Parts | Binder resin ② Amorphous resin | Parts |
|---|---|---|---|---|
| 1 | C1 | 68 | A6 | 32 |
| 2 | C2 | 68 | A6 | 32 |
| 3 | C2 | 68 | A2 | 32 |
| 4 | C2 | 68 | A3 | 32 |
| 5 | C2 | 68 | A4 | 32 |
| 6 | C2 | 68 | A5 | 32 |
| 7 | C2 | 68 | A1 | 32 |
| 8 | C2 | 68 | A8 | 32 |
| 9 | C2 | 68 | A10 | 32 |
| 10 | C2 | 68 | A11 | 32 |
| 11 | C2 | 68 | A7 | 32 |
| 12 | C2 | 68 | A9 | 32 |
| 13 | C2 | 68 | A12 | 32 |
| 14 | C2 | 25 | A6 | 75 |
| 15 | C3 | 68 | A6 | 32 |
| 16 | C4 | 68 | A6 | 32 |
| 17 | C2 | 10 | A6 | 90 |
| 18 | C5 | 68 | A6 | 32 |
| 19 | C6 | 68 | A6 | 32 |
| 20 | C7 | 68 | A6 | 32 |
| 21 | C8 | 68 | A6 | 32 |

Manufacturing Example of Binder Resin 1 Fine Particle Dispersion

Toluene: (Wake Pure Chemical) 300 parts

Binder resin 1: 100 parts

These materials were weighed, mixed and dissolved at 90° C.

5.0 parts of sodium dodecylbenzenesulfonate and 10.0 parts of sodium laurate were separately added to 700 parts of ion-exchange water, and heated to dissolve at 90° C.

The toluene solution and the aqueous solution were then mixed and stirred at 7000 rpm with a T.K. Robomix ultra-high-speed stirring unit (Primix Corp.). This was then emulsified under 200 MPa of pressure with a high-pressure impact disperser nanomizer (Yoshida Kikai Co., Ltd.). The toluene was then removed with an evaporator, and the concentration was adjusted with ion-exchange water to obtain a 20 mass % aqueous dispersion of the binder resin 1 fine particle (binder resin 1 fine particle dispersion).

The 50% particle diameter (D50) of the binder resin 1 fine particle based on volume distribution was measured with a Nanotrac UPA-EX150 (Nikkiso Co., Ltd.) and found to be 0.40 μm.

Manufacturing Example of Release Agent (Aliphatic Hydrocarbon Compound) Fine Particle Dispersion Aliphatic hydrocarbon compound HNP-51 (Nippon Seiro) 100 parts Anionic surfactant Neogen RK (Daiichi Kogyo) 5 parts Ion-exchanged water 395 parts These materials were weighed precisely, placed in a mixing vessel with an attached stirrer, heated to 90° C., and then dispersed for 60 minutes by recirculating into a Clearmix W-Motion (M Technique). The dispersion conditions were as follows.

Outer rotor diameter 3 cm

Clearance 0.3 mm

Rotor speed 19000 r/min

Screen rotation 19000 r/min

After being dispersed, this was cooled to 40° C. under conditions of rotor speed 1000 r/min, screen rotation 0 r/min, cooling speed 10° C./min to obtain a water-based dispersion (release agent (aliphatic hydrocarbon compound) fine particle dispersion) having a concentration of 20 mass % of the release agent (aliphatic hydrocarbon compound) fine particle.

The 50% volume-based particle diameter (D50) of the release agent (aliphatic hydrocarbon compound) fine particle was 0.15 μm as measured with a Nanotrac UPA-EX150 dynamic light scattering particle size distribution meter (Nikkiso).

Manufacture of Colorant Fine Particle Dispersion

Colorant 50.0 parts (Cyan pigment, Dainichi Seika Pigment Blue 15:3)

Neogen RK anionic surfactant (Daiichi Kogyo Seiyaku) 7.5 parts

Ion-exchanged water 442.5 parts

These materials were weighed precisely, mixed, dissolved, and dispersed for about 1 hour with a with a Nanomizer high-pressure impact disperser (Yoshida Kikai) to disperse the colorant and obtained a water-based dispersion (colorant fine particle dispersion) having a concentration of 10 mass % of the colorant fine particle.

The 50% volume-based particle diameter (D50) of the colorant fine particle was 0.20 μm as measured with a Nanotrac UPA-EX150 dynamic light scattering particle size distribution meter (Nikkiso).

Manufacturing Example of Toner Particle 1

Binder Resin 1 Fine Particle Dispersion 500 parts

Release agent (aliphatic hydrocarbon compound fine particle dispersion) 50 parts Colorant fine particle dispersion 80 parts Ion-exchanged water 160 parts These materials were loaded into a round-bottomed stainless steel flask, and mixed. This was then dispersed for 10 minutes at 5000 r/min with an Ultra Turrax TSO homogenizer (IKA). 1.0% aqueous nitric acid solution was added to adjust the pH to 3.0, after which the mixture was heated to 58° C. in a heating water bath using a stirring blade while adjusting number of rotations so that the mixture could be stirred.

The volume-average particle diameter of the formed aggregated particles was checked appropriately with a Coulter Multisizer 111, and once aggregated particles with a weight-average particle diameter (D4) of about 6.00 μm had formed, the pH was adjusted to 9.0 with a 5% sodium hydroxide aqueous solution. Stirring was then continued as the mixture was heated to 75° C. This was then maintained at 75° C. for 1 hour to fuse the aggregated particles.

This was then cooled to 50° C., and maintained for 3 hours to promote crystallization of the polymer.

This was then cooled to 25'C, subjected to filtration and solid-liquid separation, and washed with ion-exchanged water. After completion of washing it was dried with a vacuum drier to obtain a toner particle 1 with a weight-average particle diameter (D4) of about 6.1 μm.

Manufacturing Examples of Toner Particles 2, 5 to 24 and 29 to 35

Toner particles 2, 5 to 24 and 29 to 35 were obtained as in the manufacturing example of the toner particle 1 except that the binder resin was changed as shown in Table 4.

Manufacturing Example of Toner Particle 3

Binder resin 2: 100.0 parts

Colorant: pigment blue 15:3 6.5 parts

Aluminum di-t-butyl salicylate: 1.0 part

Paraffin wax: 10.0 parts (Nippon Seiro Co., Ltd.: HNP-51)

Toluene: 100.0 parts

A mixture of the above materials was prepared. This mixture was placed in an attritor (Nippon Coke & Engineering Co., Ltd.) and dispersed for 2 hours at 200 rpm with zirconia beads 5 mm in diameter to obtain a raw material dispersion.

Meanwhile, 735.0 parts of ion-exchanged water and 16.0 parts of trisodium phosphate (12-hydrate) were added to a vessel provided with a Homomixer high-speed agitator (Primix) and a thermometer, and stirred at 12000 rpm as the temperature was raised to 60° C. A calcium chloride aqueous solution of 9.0 parts of calcium chloride (2-hydrate) dissolved in 65.0 parts of ion-exchanged water was added, and stirred for 30 minutes at 12000 rpm with the temperature maintained at 60° C. 10% hydrochloric acid was added to adjust the pH to 6.0 and obtain a water-based medium containing a dispersion stabilizer.

Next, the above raw material dispersion was transferred to a vessel equipped with a stirrer and a thermometer, and stirred at 100 rpm as the temperature was raised to 60° C. 8.0 parts oft-butyl peroxypivalate (NOF: Perbutyl PV) were then added as a polymerization initiator, and the mixture was stirred for 5 minutes at 100 rpm with the temperature maintained at 60° C., and then added to the water-based medium as the medium was stirred at 12000 rpm with the high-speed stirring device.

The temperature was then maintained at 60° C. as stirring was continued for 20 minutes at 12000 rpm with the high-speed stirring device to obtain a granulating liquid. This granulating liquid was transferred to a reactor equipped with a reflux condenser, a stirrer, a thermometer and a nitrogen introduction pipe, and stirred at 150 rpm in a nitrogen atmosphere as the temperature was raised to 70° C. A polymerization reaction was then performed for 10 hours at 150 rpm with the temperature maintained at 70° C. The reflux condenser was then removed from the reactor, the temperature of the reaction solution was raised to 95° C., and the solution was stirred for 5 hours at 150 rpm with the temperature maintained at 95° C. to remove the toluene and obtain a toner particle dispersion.

The resulting toner particle dispersion was cooled to 20° C. while being stirred at 150 rpm, after which stirring was maintained as dilute hydrochloric acid was added to adjust the pH to 1.5 and dissolve the dispersion stabilizer. The solids were filtered out, and after thorough washing with ion-exchanged water, this was vacuum dried for 24 hours at 40° C. to obtain a toner particle 3.

Manufacturing Example of Toner Particle 4

Binder resin 2: 100.0 parts

Aliphatic hydrocarbon compound HNP-51 (Nippon Seiro Co., Ltd.): 10 parts

C.I. pigment blue 15:3: 6.5 parts 3,5-di-t-butyl aluminum salicylate compound: 0.5 parts These materials were mixed at a rotation speed of 20 $s^{-1}$ for a rotation time of 5 minutes with a Henschel mixer (FM-75, Nippon Coke & Engineering Co., Ltd.), and then kneaded at a discharge temperature of 135° C. in a twin-screw kneader (PCM-30, Ikegai) set to a screw rotation of 200 rpm at a temperature of 120° C. The kneaded product was cooled at a cooling rate of 15° C./min and coarsely crushed to not more than 1 mm in a hammer mill to obtain a crushed product. The crushed product was then pulverized with a mechanical pulverizer (T-250, Freund-Turbo Corporation).

This was then classified with a Faculty F-300 (Hosokawa Micron Corporation) to obtain a toner particle 4. For the operating conditions, the classifying rotor speed was set to 130 $s^{-1}$ and the dispersion rotor speed to 120 $s^{-1}$.

Manufacturing Example of Toner Particle 25

A toner particle 25 was obtained as in the manufacturing example of the toner particle 4 except that the type of binder resin was changed as shown in Table 4, the temperature of the twin-screw kneader was set to 120° C., and the screw rotation speed was changed to 300 rpm.

Manufacturing Example of Toner Particle 26

A toner particle 26 was obtained as in the manufacturing example of the toner particle 4 except that the type of binder resin was changed as shown in Table 4, the temperature of the twin-screw kneader was set to 120° C., and the screw rotation speed was changed to 150 rpm.

Manufacturing Example of Toner Particle 27

A toner particle 27 was obtained as in the manufacturing example of the toner particle 4 except that the type of binder resin was changed as shown in Table 4, the temperature of the twin-screw kneader was set to 100° C., and the screw rotation speed was changed to 350 rpm.

Manufacturing Example of Toner Particle 28

A toner particle 28 was obtained as in the manufacturing example of the toner particle 4 except that the type of binder resin was changed as shown in Table 4, the temperature of the twin-screw kneader was set to 140° C., and the screw rotation speed was changed to 100 rpm.

TABLE 4

| Toner particle No. | Manufacturing method | Binder resin ① | Parts | Binder resin ② | Parts |
|---|---|---|---|---|---|
| 1 | EA | Binder resin 1 | 100 | None | — |
| 2 | EA | Binder resin 2 | 100 | None | — |
| 3 | SP | Binder resin 2 | 100 | None | — |
| 4 | MK | Binder resin 2 | 100 | None | — |
| 5 | EA | Binder resin 19 | 100 | None | — |
| 6 | EA | Binder resin 20 | 100 | None | — |
| 7 | EA | Binder resin 21 | 100 | None | — |
| 8 | EA | Binder resin 3 | 100 | None | — |
| 9 | EA | Binder resin 4 | 100 | None | — |
| 10 | EA | Binder resin 5 | 100 | None | — |
| 11 | EA | Binder resin 6 | 100 | None | — |
| 12 | EA | Binder resin 7 | 100 | None | — |
| 13 | EA | Binder resin 8 | 100 | None | — |
| 14 | EA | Binder resin 9 | 100 | None | — |
| 15 | EA | Binder resin 10 | 100 | None | — |
| 16 | EA | Binder resin 11 | 100 | None | — |
| 17 | EA | Crystalline resin C2 | 68 | Amorphous resin A12 | 32 |
| 18 | EA | Crystalline resin C2 | 68 | Amorphous resin A11 | 32 |
| 19 | EA | Binder resin 13 | 100 | None | — |
| 20 | EA | Crystalline resin C2 | 50 | Amorphous resin A12 | 50 |
| 21 | EA | Crystalline resin C2 | 50 | Amorphous resin A3 | 50 |
| 22 | EA | Crystalline resin C2 | 50 | Amorphous resin A7 | 50 |
| 23 | EA | Crystalline resin C2 | 30 | Amorphous resin A7 | 70 |
| 24 | EA | Crystalline resin C2 | 95 | Amorphous resin A3 | 5 |
| 25 | MK | Crystalline resin C2 | 40 | Amorphous resin A3 | 60 |
| 26 | MK | Crystalline resin C2 | 40 | Amorphous resin A3 | 60 |
| 27 | MK | Crystalline resin C2 | 30 | Amorphous resin A3 | 70 |
| 28 | MK | Crystalline resin C2 | 30 | Amorphous resin A3 | 70 |
| 29 | EA | Binder resin 14 | 100 | None | — |
| 30 | EA | Binder resin 15 | 100 | None | — |
| 31 | EA | Binder resin 16 | 100 | None | — |
| 32 | EA | Crystalline resin C2 | 68 | Amorphous resin A13 | 32 |
| 33 | EA | Binder resin 12 | 100 | None | — |
| 34 | EA | Binder resin 17 | 100 | None | — |
| 35 | EA | Binder resin 18 | 100 | None | — |

The abbreviations in the Table 2-1 are defined as follows.

EA; Emulsion aggregation

SP: Suspension polymerization

MK: Melt kneading

Toner 1 Manufacturing Example

Toner particle 1: 100 parts

Inorganic fine particle 5: 1.0 parts

The above materials were mixed for a rotation time of 10 minutes at a rotation speed of 30 $s^{-1}$ in a FM-10C Henschel Mixer (Mitsui Miike Machinery Co., Ltd.) to obtain a toner 1. The composition of the toner 1 is shown in Table 5. The weight-average particle diameter (D4) of the toner 1 was 6.1 μm. The physical properties of the toner 1 are shown in Table 6.

Manufacturing Examples of Toners 2 to 36 and 45 to 54

Toners 2 to 36 and 45 to 54 were obtained as in the manufacturing example of the toner 1 except that the toner particles and inorganic fine particles were changed as shown in Table 5. The physical properties of the resulting toners 2 to 36 and 45 to 54 are shown in Table 6.

Manufacturing Examples of Toners 37 to 44

Toners 37 to 44 were obtained as in the manufacturing example of the toner 36 except that the types and added amounts of the toner particles and inorganic fine particles were changed as shown in Table 5. The physical properties of the resulting toners 37 to 44 are shown in Table 6.

In cross-sectional observation of the resulting toners, toners 1 to 44, 46 to 50 and 52 to 54 exhibited a domain-matrix structure composed of a matrix containing the first resin (crystalline resin) and domains containing the second resin (amorphous resin).

On the other hand, toners 45 and 51 exhibited a domain-matrix structure composed of a matrix containing the second resin and domains containing the first resin.

TABLE 5

| Toner No. | Toner particle No. | Inorganic fine particle No. | Parts |
|---|---|---|---|
| 1 | Toner particle 1 | Inorganic fine particle 5 | 1.0 |
| 2 | Toner particle 2 | Inorganic fine particle 5 | 1.0 |
| 3 | Toner particle 3 | Inorganic fine particle 5 | 1.0 |
| 4 | Toner particle 4 | Inorganic fine particle 5 | 1.0 |
| 5 | Toner particle 5 | Inorganic fine particle 5 | 1.0 |
| 6 | Toner particle 6 | Inorganic fine particle 5 | 1.0 |
| 7 | Toner particle 7 | Inorganic fine particle 5 | 1.0 |
| 8 | Toner particle 2 | Inorganic fine particle 6 | 1.0 |
| 9 | Toner particle 2 | Inorganic fine particle 7 | 1.0 |
| 10 | Toner particle 2 | Inorganic fine particle 8 | 1.0 |
| 11 | Toner particle 2 | Inorganic fine particle 9 | 1.0 |
| 12 | Toner particle 2 | Inorganic fine particle 10 | 1.0 |
| 13 | Toner particle 2 | Inorganic fine particle 11 | 1.0 |
| 14 | Toner particle 2 | Inorganic fine particle 12 | 1.0 |
| 15 | Toner particle 8 | Inorganic fine particle 12 | 1.0 |
| 16 | Toner particle 9 | Inorganic fine particle 12 | 1.0 |
| 17 | Toner particle 10 | Inorganic fine particle 12 | 1.0 |
| 18 | Toner particle 11 | Inorganic fine particle 12 | 1.0 |
| 19 | Toner particle 12 | Inorganic fine particle 12 | 1.0 |
| 20 | Toner particle 13 | Inorganic fine particle 12 | 1.0 |
| 21 | Toner particle 14 | Inorganic fine particle 12 | 1.0 |
| 22 | Toner particle 15 | Inorganic fine particle 12 | 1.0 |
| 23 | Toner particle 16 | Inorganic fine particle 12 | 1.0 |
| 24 | Toner particle 17 | Inorganic fine particle 12 | 1.0 |
| 25 | Toner particle 18 | Inorganic fine particle 12 | 1.0 |
| 26 | Toner particle 19 | Inorganic fine particle 12 | 1.0 |
| 27 | Toner particle 20 | inorganic fine particle 12 | 1.0 |
| 28 | Toner particle 21 | Inorganic fine particle 12 | 1.0 |
| 29 | Toner particle 22 | Inorganic fine particle 12 | 1.0 |
| 36 | Toner particle 23 | Inorganic fine particle 12 | 1.0 |
| 31 | Toner particle 24 | Inorganic fine particle 12 | 1.0 |
| 32 | Toner particle 21 | Inorganic fine particle 1 | 1.0 |
| 33 | Toner particle 21 | Inorganic fine particle 2 | 1.0 |
| 34 | Toner particle 21 | Inorganic fine particle 3 | 1.0 |
| 35 | Toner particle 21 | Inorganic fine particle 4 | 1.0 |
| 36 | Toner particle 21 | Inorganic fine particle 13 | 1.0 |
| 37 | Toner particle 21 | Inorganic fine particle 13 | 0.5 |
| 38 | Toner particle 21 | Inorganic fine particle 13 | 6.5 |
| 39 | Toner particle 21 | Inorganic fine particle 13 | 0.2 |
| 49 | Toner particle 21 | Inorganic fine particle 13 | 9.0 |
| 41 | Toner particle 25 | Inorganic fine particle 13 | 0.2 |
| 42 | Toner particle 26 | Inorganic fine particle 13 | 0.2 |
| 43 | Toner particle 27 | Inorganic fine particle 13 | 0.2 |
| 44 | Toner particle 28 | Inorganic fine particle 13 | 0.2 |
| 45 | Toner particle 29 | Inorganic fine particle 13 | 1.0 |
| 46 | Toner particle 30 | Inorganic fine particle 13 | 1.0 |
| 47 | Toner particle 31 | Inorganic fine particle 1 | 1.0 |
| 48 | Toner particle 35 | Inorganic fine particle 1 | 1.0 |
| 49 | Toner particle 32 | Inorganic fine particle 1 | 1.0 |
| 50 | Toner particle 33 | Inorganic fine particle 1 | 1.0 |
| 51 | Toner particle 34 | Inorganic fine particle 1 | 1.0 |
| 52 | Toner particle 2 | Inorganic fine particle 14 | 1.0 |
| 53 | Toner particle 2 | Inorganic fine particle 15 | 1.0 |
| 54 | Toner particle 2 | Inorganic fine particle 16 | 1.0 |

Table 6

| Toner No. | X | X/Y | DD | CR | CDC | Xε/Yε | Cx/Cy | (Cx + Cz)/Cy | Mw(A) | Mw(A)/Mn(A) |
|---|---|---|---|---|---|---|---|---|---|---|
| 1 | 60 | 2.3 | 10 | 25 | 10 | 10.4 | 1.2 | 1.6 | 36000 | 7.4 |
| 2 | 60 | 2.3 | 10 | 25 | 10 | 10.4 | 1.2 | 1.6 | 36000 | 7.4 |
| 3 | 60 | 2.3 | 1.0 | 25 | 10 | 10.4 | 1.2 | 1.6 | 36000 | 7.4 |
| 4 | 60 | 2.3 | 1.0 | 25 | 10 | 10.4 | 1.2 | 1.6 | 36000 | 7.4 |
| 5 | 60 | 2.3 | 1.0 | 25 | 10 | 10.4 | 1.2 | 1.6 | 36000 | 7.4 |
| 6 | 60 | 2.3 | 1.0 | 25 | 10 | 10.4 | 1.0 | 1.3 | 36000 | 7.4 |
| 7 | 60 | 2.3 | 1.0 | 25 | 10 | 10.4 | 1.7 | 2.0 | 36000 | 7.4 |
| 8 | 60 | 2.3 | 1.0 | 25 | 10 | 10.4 | 2.8 | 3.5 | 36000 | 7.4 |
| 9 | 60 | 2.3 | 1.0 | 25 | 10 | 9.6 | 1.2 | 1.6 | 36000 | 7.4 |
| 10 | 60 | 2.3 | 1.0 | 25 | 24 | 9.6 | 5.5 | 7.0 | 36000 | 7.4 |
| 11 | 60 | 2.3 | 1.0 | 25 | 30 | 10 | 0.9 | 1.2 | 36000 | 7.4 |
| 12 | 60 | 2.3 | 1.0 | 25 | 66 | 10.4 | 0.8 | 1.0 | 36000 | 7.4 |
| 13 | 60 | 2.3 | 1.0 | 25 | 72 | 9.6 | 7.3 | 8.3 | 36000 | 7.4 |
| 14 | 60 | 2.3 | 1.0 | 25 | 84 | 8 | 7.3 | 8.3 | 36000 | 7.4 |
| 15 | 60 | 2.3 | 1.0 | 25 | 84 | 8 | 7.3 | 8.3 | 36000 | 7.4 |
| 16 | 60 | 2.3 | 1.0 | 25 | 84 | 8 | 7.3 | 8.3 | 36000 | 7.0 |
| 17 | 60 | 2.3 | 1.0 | 25 | 84 | 8 | 7.3 | 8.7 | 36000 | 7.4 |
| 18 | 60 | 2.3 | 1.0 | 25 | 84 | 8 | 7.3 | 8.3 | 36000 | 7.4 |
| 19 | 60 | 2.3 | 1.0 | 25 | 84 | 8 | 7.3 | 8.3 | 36000 | 7.4 |
| 20 | 60 | 2.3 | 1.0 | 25 | 77 | 8 | 7.3 | 8.3 | 36000 | 7.4 |
| 21 | 60 | 2.3 | 1.0 | 25 | 84 | 8 | 7.3 | 8.7 | 36000 | 7.4 |
| 22 | 60 | 2.3 | 1.0 | 25 | 92 | 8 | 7.3 | 8.8 | 36000 | 7.4 |
| 23 | 60 | 2.3 | 1.0 | 25 | 84 | 8 | 7.3 | 12.7 | 36000 | 7.4 |
| 24 | 70 | 2.3 | 1.0 | 25 | 94 | 10 | 7.3 | 11.0 | 36000 | 7.4 |
| 25 | 70 | 2.3 | 1.0 | 25 | 94 | 8 | 7.3 | 8.8 | 36000 | 7.4 |
| 26 | 60 | 2.3 | 1.0 | 25 | 94 | 10 | 7.3 | 11.0 | 36000 | 7.4 |
| 27 | 50 | 1.0 | 1.0 | 25 | 98 | 10 | 7.3 | 11.0 | 36000 | 7.4 |
| 28 | 50 | 1.0 | 1.0 | 25 | 98 | 8 | 7.3 | 8.3 | 26000 | 7.8 |
| 29 | 50 | 1.0 | 1.0 | 25 | 98 | 8 | 7.3 | 12.7 | 56000 | 6.2 |
| 30 | 30 | 0.4 | 1.0 | 25 | 98 | 8 | 7.3 | 12.7 | 62000 | 5.0 |
| 31 | 95 | 19.0 | 0.2 | 25 | 98 | 8 | 7.3 | 8.3 | 24000 | 8.4 |
| 32 | 50 | 1.0 | 1.0 | 25 | 96 | 14 | 1.2 | 1.4 | 26000 | 7.8 |
| 33 | 50 | 1.0 | 1.0 | 25 | 96 | 20 | 1.2 | 1.4 | 26000 | 7.8 |
| 34 | 50 | 1.0 | 1.0 | 25 | 8 | 36 | 1.2 | 1.4 | 26000 | 7.8 |
| 35 | 50 | 1.0 | 1.0 | 25 | 12 | 7.6 | 1.2 | 1.4 | 26000 | 7.8 |
| 36 | 50 | 1.0 | 1.0 | 25 | 110 | 18 | 7.3 | 8.3 | 26000 | 7.8 |
| 37 | 50 | 1.0 | 1.0 | 15 | 110 | 18 | 7.3 | 8.3 | 26000 | 7.8 |
| 38 | 50 | 1.0 | 1.0 | 75 | 110 | 18 | 7.3 | 8.3 | 26000 | 7.8 |
| 39 | 50 | 1.0 | 1.0 | 5 | 110 | 18 | 7.3 | 8.3 | 26000 | 7.8 |
| 40 | 50 | 1.0 | 1.0 | 85 | 110 | 18 | 7.3 | 8.3 | 26000 | 7.8 |
| 41 | 40 | 0.7 | 0.4 | 5 | 110 | 18 | 7.3 | 8.3 | 26000 | 7.8 |
| 42 | 40 | 0.7 | 1.9 | 5 | 110 | 18 | 7.3 | 8.3 | 26000 | 7.8 |
| 43 | 30 | 0.4 | 0.1 | 5 | 110 | 18 | 7.3 | 8.3 | 26000 | 7.8 |
| 44 | 30 | 0.4 | 3.0 | 5 | 110 | 18 | 7.3 | 8.3 | 26000 | 7.8 |
| 45 | 23 | 0.3 | 1.0 | 25 | 4 | 14 | 1.2 | 9.3 | 36000 | 7.4 |
| 46 | 60 | 2.3 | 1.0 | 25 | 4 | 14 | 1.2 | 9.3 | 36000 | 7.4 |
| 47 | 60 | 2.3 | 1.0 | 25 | 4 | 14 | 0.6 | 0.9 | 36000 | 7.4 |
| 48 | 60 | 2.3 | 1.0 | 25 | 4 | 14 | 1.2 | 1.6 | 36000 | 7.4 |
| 49 | 70 | 2.3 | 1.0 | 25 | 4 | 14 | 1.2 | 1.2 | 36000 | 7.4 |
| 50 | 60 | 2.3 | 1.0 | 25 | 4 | 14 | 1.2 | 1.6 | 36000 | 7.4 |
| 51 | 9 | 0.1 | 1.0 | 25 | 4 | 14 | 1.2 | 1.6 | 36000 | 7.4 |
| 52 | 60 | 2.3 | 1.0 | 25 | 78 | 24 | — | — | 36000 | 7.4 |
| 53 | 60 | 2.3 | 1.0 | 25 | 180 | — | 7.3 | 9.3 | 36000 | 7.4 |
| 54 | 60 | 2.3 | 1.0 | 25 | 6 | 6 | 7.3 | 9.3 | 36000 | 7.4 |

The abbreviations in the Table 6 are defined as follow
DD: Domain diameter
CR: Coverage ratio
CDC: Charge decay rate coefficient In the tables, X is the content (mass %) of the first resin in the binder resin. The domain diameter is the number average diameter (in μm). The coverage ratio is given in units of area %.

Manufacturing Example of Magnetic Carrier 1

Magnetite 1 with number-average particle diameter of 0.30 μm (magnetization strength 65 $Am^2/kg$ in 1000/4π (kA/m) magnetic field)

Magnetite 2 with number-average particle diameter of 0.50 μm (magnetization strength 65 Am/kg in 1000/4π (kA/m) magnetic field)

4.0 parts of a silane compound (3-(2-aminoethylamino-propyl)trimethoxysilane) were added to 100 parts each of the above materials, and mixed and stirred at high speed at 100° C. or more in a vessel to treat the respective fine particles.

Phenol: 10 mass %

Formaldehyde solution: 6 mass %

(formaldehyde 40 mass %, methanol 10 mass %, water 50 mass %)

Magnetite 1 treated with silane compound: 58 mass %

Magnetite 2 treated with silane compound: 26 mass %

100 parts of these materials, 5 parts of 28 mass % aqueous ammonia solution and 20 parts of water were placed in a flask, and stirred and mixed as the temperature was raised to 85° C. for 30 minutes, and maintained for 3 hours to perform a polymerization reaction, and the resulting phenol resin was hardened.

The hardened phenol resin was then cooled to 30° C., water was added, the supernatant was removed, and the precipitate was water washed and air dried. This was then dried at 60° C. under reduced pressure (5 mmHg or less) to obtain a magnetic dispersion-type spherical magnetic carrier. The volume-based 50% particle diameter (D50) was 34.2 μm.

Manufacturing Example of Two-Component Developer 1

92.0 parts of the magnetic carrier 1 and 8.0 parts of the toner 1 were mixed in a V-type mixer (V-20, Seishin Enterprise Co., Ltd.) to obtain a two-component developer 1.

Manufacturing Examples of Two-Component Developers 2 to 54

The two-component developers 2 to 54 were obtained as in the manufacturing example of the two-component developer 1 except that the toners were changed as shown in Table 7.

TABLE 7

| Toner No. | Carrier No. | Two-component developer No. |
|---|---|---|
| Toner 1 | Carrier 1 | Two-component developer 1 |
| Toner 2 | Carrier 1 | Two-component developer 2 |
| Toner 3 | Carrier 1 | Two-component developer 3 |
| Toner 4 | Carrier 1 | Two-component developer 4 |
| Toner 5 | Carrier 1 | Two-component developer 5 |
| Toner 6 | Carrier 1 | Two-component developer 6 |
| Toner 7 | Carrier 1 | Two-component developer 7 |
| Toner 8 | Carrier 1 | Two-component developer 8 |
| Toner 9 | Carrier 1 | Two-component developer 9 |
| Toner 10 | Carrier 1 | Two-component developer 10 |
| Toner 11 | Carrier 1 | Two-component developer 11 |
| Toner 12 | Carrier 1 | Two-component developer 12 |
| Toner 13 | Carrier 1 | Two-component developer 13 |
| Toner 14 | Carrier 1 | Two-component developer 14 |
| Toner 15 | Carrier 1 | Two-component developer 15 |
| Toner 16 | Carrier 1 | Two-component developer 16 |
| Toner 17 | Carrier 1 | Two-component developer 17 |
| Toner 18 | Carrier 1 | Two-component developer 18 |
| Toner 19 | Carrier 1 | Two-component developer 19 |
| Toner 20 | Carrier 1 | Two-component developer 20 |
| Toner 21 | Carrier 1 | Two-component developer 21 |
| Toner 22 | Carrier 1 | Two-component developer 22 |
| Toner 23 | Carrier 1 | Two-component developer 23 |
| Toner 24 | Carrier 1 | Two-component developer 24 |
| Toner 25 | Carrier 1 | Two-component developer 25 |
| Toner 26 | Carrier 1 | Two-component developer 26 |
| Toner 27 | Carrier 1 | Two-component developer 27 |
| Toner 28 | Carrier 1 | Two-component developer 28 |
| Toner 29 | Carrier 1 | Two-component developer 29 |
| Toner 30 | Carrier 1 | Two-component developer 30 |
| Toner 31 | Carrier 1 | Two-component developer 31 |
| Toner 32 | Carrier 1 | Two-component developer 32 |
| Toner 33 | Carrier 1 | Two-component developer 33 |
| Toner 34 | Carrier 1 | Two-component developer 34 |
| Toner 35 | Carrier 1 | Two-component developer 35 |
| Toner 36 | Carrier 1 | Two-component developer 36 |
| Toner 37 | Carrier 1 | Two-component developer 37 |
| Toner 38 | Carrier 1 | Two-component developer 38 |
| Toner 39 | Carrier 1 | Two-component developer 39 |
| Toner 40 | Carrier 1 | Two-component developer 40 |
| Toner 41 | Carrier 1 | Two-component developer 41 |
| Toner 42 | Carrier 1 | Two-component developer 42 |
| Toner 43 | Carrier 1 | Two-component developer 43 |
| Toner 44 | Carrier 1 | Two-component developer 44 |
| Toner 45 | Carrier 1 | Two-component developer 45 |
| Toner 46 | Carrier 1 | Two-component developer 46 |
| Toner 47 | Carrier 1 | Two-component developer 47 |
| Toner 48 | Carrier 1 | Two-component developer 48 |
| Toner 49 | Carrier 1 | Two-component developer 49 |

TABLE 7-continued

| Toner No. | Carrier No. | Two-component developer No. |
|---|---|---|
| Toner 50 | Carrier 1 | Two-component developer 50 |
| Toner 51 | Carrier 1 | Two-component developer 51 |
| Toner 52 | Carrier 1 | Two-component developer 52 |
| Toner 53 | Carrier 1 | Two-component developer 53 |
| Toner 54 | Carrier 1 | Two-component developer 54 |

Toner Evaluation Methods

Charge Rising Performance Evaluation

Charge rising performance is evaluated by measuring the density change when images with different image printing ratios and densities are output. An image with a low image ratio is output to saturate the charge of the toner in the developing unit, and an image with a high image ratio is output. A density change occurs as a result due to the difference in charge between the charge-saturated toner already in the developing unit and the new toner supplied to the developing unit.

Because toner with rapid charge rising becomes rapidly saturated with charge after being supplied to the developing unit, there is little density change. On the other hand, a toner with slow charge rising takes time to become saturated with charge after being supplied to the developing unit, lowering the charge quantity of the toner as a whole and changing the density.

Using a Canon imagePress C800 full-color copier as the image-forming apparatus, two-component developer to be evaluated was placed in the cyan developing device of the image-forming apparatus, and toner to be evaluated was placed in a cyan toner container and evaluated as follows.

As modifications, the mechanism for removing excess magnetic carrier from inside the developing device was removed. Ordinary GF-C081 paper (A4, basis weight 81.4 g/m$^2$. Canon Marketing Japan) was used as the evaluation paper.

The laid-on level of the toner on the paper in an FFh image (solid image) was adjusted to 0.45 mg/cm$^2$. FFh is a value obtained by displaying 256 tones in hexadecimal notation, with 00h being the first of 256 tones (white background), and FF being the 256th tone (solid part).

An image output test was performed by outputting 1000 prints with an image ratio of 1%. During 1000 sheets of continuous paper feed, the developing conditions and transfer conditions (without calibration) were the same as for the first print.

An image output test was then performed by outputting 1000 prints at an image ratio of 80%. During 1000 sheets of continuous paper feed, the developing conditions and transfer conditions (without calibration) were the same as for the first print.

The image density of the 1000th print in printing at an image ratio of 1% was taken as the initial density. The density of the 1000th image in printing at an image ratio of 80% was measured, and was evaluated according to the following evaluation criteria.

This test was performed in a high-temperature, high-humidity environment (H/H; 30° C., RH 80%), and in a normal-temperature, low humidity environment (N/L; 23° C., RH 5%).

(1) Measuring Image Density Changes

Using an X-Rite color reflection densitometer (500 Series, X-Rite Inc.), the initial density and the density of the 1000th image in printing at an image ratio of 80% were measured and ranked according to the following standard. A rank of D is more means that the effects of the present invention have been obtained. The evaluation results are shown in Table 8.

(Density Difference)

AA: Less than 0.02

A: at least 0.02 and less than 0.04

BB: at least 0.04 and less than 0.06

B: at least 0.06 and less than 0.08

CC: at least 0.08 and less than 0.10

C: at least 0.10 and less than 0.12

D: at least 0.12 and less than 0.15

E: at least 0.15

Method for Evaluating Charge Retention Characteristics in High-Temperature High-Humidity Environment The toner on the electrostatic latent image bearing member was collected by suction with a metal cylindrical tube and a cylindrical filter to measure the triboelectric charge quantity of the toner.

Specifically, the triboelectric charge quantity of the toner on the electrostatic latent image bearing member was measured with a Faraday cage. A Faraday cage is a coaxial double cylinder in which the inner and outer cylinder are insulated from each other. If a charged body with a charge quantity Q is placed in the inner cylinder, electrostatic induction makes it as though there is a metal cylinder with a charge quantity Q. This induced charge quantity is measured with an electrometer (Keithley 6517A, Keithley), and the charge quantity Q (mC) is divided by the toner mass M (kg) in the inner cylinder (Q/M), and regarded as the triboelectric charge quantity of the toner.

Toner Triboelectric Charge Quantity (mC/Kg)=Q/M

The image for evaluation was first formed on the electrostatic latent image bearing member, and before it could be transferred to the intermediate transfer member, the rotation of the electrostatic latent image bearing member was stopped, and the toner on the electrostatic latent image bearing member was collected by suction with a metal cylindrical tube and a cylindrical filter, and "initial Q/M" was measured.

Next, the evaluation unit was left standing for two weeks with the developing device still installed in a high-temperature, high-humidity environment (H/H), the same operations were performed as before, and the charge quantity Q/M (mC/kg)per unit mass on the electrostatic latent image bearing member after standing was measured. The initial Q/M per unit mass on the electrostatic latent image bearing member is taken as 100%, the retention rate of Q/M per unit mass on the electrostatic latent image bear member after standing ([Q/M after standing]/[initial Q/M]×100) was calculated and evaluated according to the following standard. A rank of D or greater indicates that the effects of the invention have been obtained. The evaluation results are shown in Table 8.

(Evaluation Standard)

AA: Retention rate at least 98%

A: Retention rate at least 95% and less than 98%

BB: Retention rate at least 90% and less than 95%

B: Retention rate at least 85% and less than 90%

CC: Retention rate at least 80% and less than 85%

C: Retention rate at least 75% and less than 80%

D: Retention rate at least 70% and less than 75%

E: Retention rate less than 70%

Method for Evaluating Low-Temperature Fixability

Paper: GFC-081 (81.0 g/m$^2$)(sold by Canon Marketing Japan Inc.)

Toner laid-on level on paper: 0.50 mg/cm$^2$ (adjusted by means of DC voltage VDC of developer carrying member, charging voltage VD of electrostatic latent image bearing member, and laser power)

Evaluation image: 2 cm×5 cm image in center of the A4 paper

Test environment: Low-temperature low-humidity environment of 15° C., 10% RH (hereunder called "L/L")

Fixing temperature: 130° C.

Process speed: 377 mm/sec

The evaluation image was output and evaluated for low-temperature fixability. The image density decrease rate was used as the evaluation standard for low-temperature fixability.

For the image density decrease rate, the image density in the center of the image was first measured with an X-Rite color reflection densitometer (500 Series, X-Rite Inc.). The fixed image was then rubbed (5 passes) with Silbon paper under 4.9 kPa (50 g/cm$^2$) of load on the part that had been measured for image density, and the image density was measured again.

The decrease in image density after rubbing was then calculated by the following formula. The resulting image density decrease rate was evaluated according to the following standard. A rank of at least D means that the effects of the present invention have been obtained. The evaluation results are shown in Table 8.

Image density decrease rate=(image density before rubbing−image density after rubbing)/image density before rubbing×100

(Evaluation Standard)

AA: Image density decrease rate less than 3.0%

A: Image density decrease rate at least 3.0% and less than 5.0%

BB: Image density decrease rate at least 5.0% and less than 10.0%

B: Image density decrease rate at least 10.0% and less than 15.0%

CC: Image density decrease rate at least 15.0% and less than 20.0%

C: Image density decrease rate at least 20.0% and less than 25.0%

D: Image density decrease rate at least 25.0% and less than 30.0%

E: Image density decrease rate at least 30.0%

Method for Evaluating Hot Offset (H.O) Resistance

Using a modified Canon imagePRESS C800 full-color copier as the unfixed image-forming unit, the above two-component developer was placed in the cyan station developing device and evaluated.

GFC-081 plain copy paper (A4, basis weight 81.4 g/m$^2$, Canon Marketing Japan Inc.) was used as the evaluation paper. An unfixed toner image (toner laid-on level 0.08 mg/cm$^2$) 2.0 cm long and 15.0 cm wide were formed on a part 2.0 cm from the top of the paper in the direction of paper feed in a normal-temperature normal-humidity (23° C., 60% RH) environment.

A fixing test was performed using a fixing unit that had been removed from an imageRUNNER ADVANCE C5255 Canon full-color copier and modified so that the fixing temperature could be adjusted. In a normal-temperature normal-humidity environment (23° C., 5% RH), the process speed was set to 265 mm's, and the temperature was raised from 160° C. to 210° C. in 5° C. increments as fixed images were obtained at each temperature from the previous unfixed images. The resulting fixed images were then evaluated for hot offset resistance.

Hot offset was evaluated visually in the fixed images and judged according to the following standard. A rank of at least D means that the effects of the present invention have been obtained. The evaluation results are shown in Table 8.

(Evaluation Standard)

AA: No hot offset even at 210° C.

A: Hot offset at 205° C.

BB: Hot offset at 200° C.

B: Hot offset at 195° C.

CC: Hot offset at 190° C.

C: Hot offset at least at 180° C. and less than 190° C.

D: Hot offset at least at 170° C. and less than 180° C.

E: Hot offset at below 170° C.

Examples 1 to 44

The toners 1 to 44 (two-component developers 1 to 44) were subjected to the above evaluations.

Comparative Examples 1 to 10

The toners 45 to 54 (two-component developers 45 to 54) were subjected to the above evaluations.

TABLE 8

| | Low-temperature fixability LL | | H.O resistance | | Charge rising | | | | HH charge retention HH | |
|---|---|---|---|---|---|---|---|---|---|---|
| | Density | | NL | | performance | | | | Retention | |
| Toner | decrease | | HOT | | HH | | NL | | rate | |
| No. | rate (%) | Rank | (° C.) | Rank | CD | Rank | CD | Rank | (%) | Rank |
| 1 | 0.9 | AA | 210 | AA | 0.01 | AA | 0.01 | AA | 99 | AA |
| 2 | 1.0 | AA | 205 | A | 0.01 | AA | 0.01 | AA | 99 | AA |
| 3 | 1.2 | AA | 205 | A | 0.01 | AA | 0.01 | AA | 99 | AA |
| 4 | 1.3 | AA | 205 | A | 0.01 | AA | 0.01 | AA | 98 | AA |
| 5 | 1.5 | AA | 205 | A | 0.01 | AA | 0.02 | A | 99 | AA |
| 6 | 1.5 | AA | 205 | A | 0.01 | AA | 0.03 | A | 98 | AA |
| 7 | 1.5 | AA | 205 | A | 0.02 | A | 0.01 | AA | 96 | A |
| 8 | 1.5 | AA | 205 | A | 0.04 | BB | 0.02 | A | 96 | A |
| 9 | 1.5 | AA | 205 | A | 0.04 | BB | 0.03 | A | 96 | A |
| 10 | 2.5 | AA | 205 | A | 0.05 | BB | 0.03 | A | 97 | A |
| 11 | 2.5 | AA | 205 | A | 0.04 | BB | 0.02 | A | 95 | A |
| 12 | 2.5 | AA | 205 | A | 0.04 | BB | 0.05 | BB | 96 | A |
| 13 | 2.5 | AA | 205 | A | 0.06 | B | 0.05 | BB | 92 | BB |
| 14 | 2.5 | AA | 205 | A | 0.06 | B | 0.06 | B | 94 | BB |
| 15 | 3.5 | A | 205 | A | 0.06 | B | 0.06 | B | 87 | B |
| 16 | 3.5 | A | 205 | A | 0.06 | B | 0.06 | B | 88 | B |
| 17 | 3.5 | A | 205 | A | 0.06 | B | 0.06 | B | 88 | B |
| 18 | 3.5 | A | 205 | A | 0.06 | B | 0.06 | B | 86 | B |
| 19 | 4.0 | A | 205 | A | 0.06 | B | 0.06 | B | 88 | B |
| 20 | 3.5 | A | 205 | A | 0.06 | B | 0.06 | B | 84 | CC |
| 21 | 3.5 | A | 205 | A | 0.06 | B | 0.06 | B | 89 | B |
| 22 | 3.5 | A | 205 | A | 0.06 | B | 0.08 | CC | 88 | B |
| 23 | 3.5 | A | 205 | A | 0.06 | B | 0.06 | B | 86 | B |
| 24 | 4.5 | A | 200 | BB | 0.06 | B | 0.06 | B | 82 | CC |
| 25 | 5.5 | BB | 200 | BB | 0.06 | B | 0.06 | B | 81 | CC |
| 26 | 4.5 | A | 205 | A | 0.06 | B | 0.06 | B | 86 | B |
| 27 | 5.5 | BB | 200 | BB | 0.06 | B | 0.06 | B | 80 | CC |
| 28 | 5.5 | BB | 195 | B | 0.06 | B | 0.06 | B | 81 | CC |
| 29 | 13.0 | B | 200 | BB | 0.06 | B | 0.06 | B | 81 | CC |
| 30 | 18.0 | CC | 195 | B | 0.06 | B | 0.08 | CC | 81 | CC |
| 31 | 13.0 | B | 190 | CC | 0.06 | B | 0.08 | CC | 82 | CC |
| 32 | 5.5 | BB | 195 | B | 0.05 | BB | 0.05 | BB | 86 | B |
| 33 | 5.5 | BB | 195 | B | 0.05 | BB | 0.08 | CC | 86 | B |
| 34 | 5.5 | BB | 195 | B | 0.08 | CC | 0.08 | CC | 86 | B |
| 35 | 5.5 | BB | 195 | B | 0.08 | CC | 0.08 | CC | 86 | B |
| 36 | 5.5 | BB | 195 | B | 0.06 | B | 0.08 | CC | 73 | D |
| 37 | 5.5 | BB | 195 | B | 0.08 | CC | 0.08 | CC | 73 | D |
| 38 | 13.0 | B | 195 | B | 0.08 | CC | 0.08 | CC | 73 | D |
| 39 | 5.5 | BB | 195 | B | 0.11 | C | 0.11 | C | 73 | D |
| 40 | 18.0 | CC | 195 | B | 0.09 | CC | 0.09 | CC | 73 | D |
| 41 | 5.5 | BB | 190 | CC | 0.11 | C | 0.11 | C | 73 | D |
| 42 | 18.0 | CC | 195 | B | 0.11 | C | 0.11 | C | 73 | D |
| 43 | 5.5 | BB | 180 | C | 0.11 | C | 0.11 | C | 73 | D |
| 44 | 22.0 | C | 195 | B | 0.11 | C | 0.11 | C | 74 | D |
| 45 | 31.0 | E | 170 | D | 0.11 | C | 0.11 | C | 72 | D |
| 46 | 31.0 | E | 170 | D | 0.11 | C | 0.11 | C | 73 | D |
| 47 | 31.0 | E | 170 | D | 0.13 | D | 0.15 | E | 73 | D |
| 48 | 22.0 | C | 180 | C | 0.13 | D | 0.15 | E | 73 | D |
| 49 | 28.0 | D | 180 | C | 0.14 | D | 0.16 | E | 73 | D |
| 50 | 28.0 | D | 180 | C | 0.10 | C | 0.14 | D | 68 | E |
| 51 | 31.0 | E | 165 | E | 0.11 | C | 0.11 | C | 73 | D |
| 52 | 2.0 | AA | 205 | A | 0.17 | E | 0.18 | E | 67 | E |

TABLE 8-continued

| Toner No. | Low-temperature fixability LL Density decrease rate (%) | Rank | H.O resistance NL HOT (° C.) | Rank | Charge rising performance HH CD | Rank | NL CD | Rank | HH charge retention HH Retention rate (%) | Rank |
|---|---|---|---|---|---|---|---|---|---|---|
| 53 | 2.0 | AA | 205 | A | 0.18 | E | 0.20 | E | 67 | E |
| 54 | 2.0 | AA | 205 | A | 0.17 | E | 0.19 | E | 67 | E |

The abbreviations in the Table 8 are defined as follows.
HOT: H.O occurrence temperature
CD: Concentration difference While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-225469, filed Dec. 13, 2019, which is hereby incorporated by reference herein in its entirety.

What is claimed is:

1. A toner, comprising:

a toner particle containing a binder resin including a crystalline first resin having an acid value of 3 to 30 mg KOH/g and an amorphous second resin having an acid value of 5 to 40 mg KOH/g; and an inorganic fine particle having a volume resistivity of $1.0\times10^{5}$ to $1.0\times10^{13}$ Ω·cm on a surface of the toner particle, with a compound having an alkyl group on a surface of the inorganic fine particle, wherein a domain matrix structure formed of a matrix containing the crystalline first resin and domains containing the amorphous second resin appears in a cross-sectional observation of the toner, the crystalline first resin has a first monomer unit at a content ratio of 30.0 to 67.0 mass % represented by formula (1)

(1)

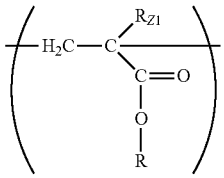

where $R_{Z1}$ represents a hydrogen atom or methyl group, and R represents a $C_{18-36}$ alkyl group, and the crystalline first resin is obtained by polymerizing a monomer composition consisting of (i) behenyl acrylate or stearyl acrylate, (ii) (meth)acrylonitrile, (iii) styrene and (iv) (meth)acrylic acid.

2. The toner according to claim 1, wherein X/Y is 0.2 to 2.5 when X and Y are respectively the masses of the crystalline first resin and the amorphous second resin in the binder resin.

3. The toner according to claim 1, wherein a number-average diameter of domains in the cross-sectional observation is 0.1 to 2.0 μm.

4. The toner according to claim 1, wherein a coverage ratio of the toner particle by the inorganic fine particle is 10 to 80 area %.

5. The toner according to claim 1, wherein the inorganic fine particle has a dielectric constant at 2 kHz of 20 to 60 pF/m.

6. The toner according to claim 1, wherein the compound having an alkyl group is at least one member selected from the group consisting of compounds having $C_{4-24}$ alkyl groups.

7. The toner according to claim 1, wherein the compound having an alkyl group is at least one member selected from the group consisting of fatty acids, fatty acid metal salts, silicone oils and silane coupling agents.

8. The toner according to claim 1, wherein the compound having an alkyl group has a structure represented by $(R^{9}—COO)_{p}M(OH)_{q}$ where $R^{9}$ independently represents a $C_{4-24}$ linear or branched alkyl group or a $C_{4-24}$ linear or branched hydroxyalkyl group, M is Al, Zn, Mg, Ca, Sr, K or Na, p is an integer from 1 to 3, and q is an integer from 0 to 2.

9. The toner according to claim 1, wherein the inorganic fine particle is at least one member selected from the group consisting of titanium oxide fine particles, strontium titanate fine particles, calcium titanate fine particles and zinc oxide fine particles.

10. The toner according to claim 1, wherein Xε/Yε is 5.0 to 170.0 when Xε and Yε are respectively dielectric constants of the inorganic fine particle and the second resin at 2 kHz.

11. The toner according to claim 1, wherein Yε is 2.0 to 3.0 pF/m.

12. The toner according to claim 1, wherein Cx/Cy is 0.8 to 24.0 when Cx is the carbon number of R and Cy is the carbon number of the alkyl group of the compound having an alkyl group.

13. The toner according to claim 1, wherein the binder resin contains a third resin comprising a resin linking the crystalline first resin to the amorphous second resin.

14. The toner according to claim 1, wherein the amorphous second resin contains at least one member selected from the group consisting of vinyl resins, polyester resins, and hybrid resins including vinyl resins linked to polyester resins.

15. The toner according to claim 1, wherein the amorphous second resin is a polyester resin having a polycondensation structure of dodecenylsuccinic acid or anhydride thereof.

16. The toner according to claim 15, wherein the polyester resin has a polycondensation structure of a carboxylic acid component other than the polycondensation structure of dodecenylsuccinic acid or anhydride thereof.

17. The toner according to claim 1, wherein Mw(A) is 25,000 to 60,000 and Mw(A)/Mn(A) is 5 to 10 when Mw(A) and Mn(A) are respectively weight-average and number-average molecular weights of a tetrahydrofuran-soluble component of the toner as measured by gel permeation chromatography.

18. The toner according to claim 1, wherein a content of the crystalline first resin in the binder resin is at least 30.0 mass %.

19. The toner according to claim 1, wherein the crystalline first resin has a second monomer unit that is different from the first monomer unit, the second monomer unit being at least one member selected from the group consisting of monomer units represented by formulae (2) and (3)

(2)

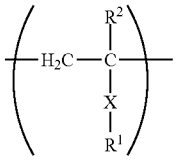

(3)

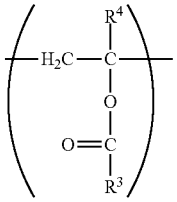

where X is a single bond or $C_{1-6}$ alkylene group, $R^1$ is —C≡N, —C(=O)NHR$^{10}$ (where $R^{10}$ represents a hydrogen atom or $C_{1-4}$ alkyl group), a hydroxy group, —COOR$^{11}$ (where $R^{11}$ represents a $C_{1-6}$ alkyl group or $C_{1-6}$ hydroxyalkyl group), —NH—C(=O)—N($R^{13}$)$_2$ (where each of two $R^{13}$s independently represents a hydrogen atom or $C_{1-6}$ alkyl group), —COO($CH_2$)$_2$NHCOOR$^{14}$ (where $R^{14}$ represents a $C_{1-4}$ alkyl group) or —COO($CH_2$)$_2$—NH—C(=O)—N($R^{15}$)$_2$ (where each of two $R^{15}$s independently represents a hydrogen atom or $C_{1-6}$ alkyl group), $R^2$ represents a hydrogen atom or methyl group, $R^3$ represents a $C_{1-4}$ alkyl group, and $R^4$ represents a hydrogen atom or methyl group, and wherein $SP_{21}$ is at least 21.00 $(J/cm^3)^{0.5}$ when $SP_{21}$ is an SP value of the second monomer unit.

20. A two-component developer comprising a magnetic carrier and the toner according to claim 1.

21. The toner according to claim 1, wherein the volume resistivity of the inorganic fine particle is $1.0\times10^8$ to $7.0\times10^{12}$ Ωcm.

22. The toner according to claim 1, wherein the inorganic fine particle is a titanium oxide fine particle.

23. The toner according to claim 1, wherein the compound having an alkyl group is a stearic acid.

24. The toner according to claim 1, wherein the inorganic fine particle is a titanium oxide fine particle, the compound having an alkyl group is a stearic acid, and the inorganic fine particle has a volume resistivity of $1.0\times10^8$ to $7.0\times10^{12}$ Ωcm.

* * * * *